United States Patent [19]

Waddell et al.

[11] Patent Number: 5,016,655

[45] Date of Patent: May 21, 1991

[54] CIGARETTE MANUFACTURING PROCESS

[75] Inventors: William J. Waddell; Carolyn Marlowe, both of Prospect; L. Douglas Keeney, Louisville, all of Ky.

[73] Assignee: C.A. Blockers, Inc., Louisville, Ky.

[21] Appl. No.: 302,284

[22] Filed: Jan. 27, 1989

Related U.S. Application Data

[63] Continuation-in-part of Ser. No. 149,482, Jan. 28, 1988, which is a continuation-in-part of Ser. No. 921,823, Oct. 21, 1986, which is a continuation of Ser. No. 834,129, Feb. 26, 1986, abandoned, which is a continuation of Ser. No. 506,824, Jun. 23, 1983, abandoned, said Ser. No. 921,823, is a continuation-in-part of Ser. No. 84,798, Aug. 13, 1987.

[51] Int. Cl.[5] ..... A24B 15/30

[52] U.S. Cl. ..... 131/310; 131/331; 131/334; 131/335

[58] Field of Search ..... 131/331, 335, 309, 310, 131/334

[56] References Cited

U.S. PATENT DOCUMENTS

| | | | |
|---|---|---|---|
| 687,308 | 11/1901 | Hawkins . | |
| 937,081 | 10/1909 | Heddles . | |
| 1,920,588 | 8/1933 | Pacini . | |
| 3,339,558 | 9/1967 | Waterbury . | |
| 3,547,130 | 12/1970 | Harlow . | |
| 3,817,258 | 6/1974 | Ernow . | |
| 3,854,487 | 12/1974 | Molins et al. . | |
| 3,884,246 | 5/1975 | Walker | 131/335 |
| 4,022,224 | 5/1977 | Saifer et al. . | |
| 4,236,532 | 12/1980 | Schweizer et al. . | |
| 4,449,541 | 5/1984 | Mays et al. . | |
| 4,516,588 | 5/1985 | Rudolph et al. . | |
| 4,617,945 | 10/1986 | Vos et al. . | |

FOREIGN PATENT DOCUMENTS

| | | |
|---|---|---|
| 55-79319 | 6/1980 | Japan . |
| 1204018 | 9/1970 | United Kingdom . |

*Primary Examiner*—V. Millin

*Attorney, Agent, or Firm*—Banner, Birch, McKie & Beckett

[57] ABSTRACT

A process for manufacturing cigarettes which impose reduced health risks to the smokers thereof. According to this process redried cut rag tobacco is directly sprayed with one or more pre-selected alcohols (or other compounds) which are capable, when the vapors thereof are inhaled by the smoker, of inhibiting or blocking the selective localization of at least one nitrosamine and/or a metabolite thereof in the smoker's tissues, such as those of the epithelial lining of his lungs. An example of such an alcohol is cyclohexanol in an ethyl alcohol soltuion. Other preferred alcohols are 3-methylcyclohexanol, 1-hexanol, 2-octanol and t-butanol. After the alcohol either directly or in a solution (such as a flavorant—SD alcohol-4 solution) has been sprayed on the tobacco, preferably as it tumbles in the cooler cylinder of the mechanized cigarette making line, and allowed to dry, the tobacco is made or machined in a conventional manner into the final cigarette, either filtered or unfiltered. The blocking alcohol is then efficiently heat released into the tobacco smoke stream as the cigarette is smoked, resulting in the desired blocking effect in the smoker, without noticeably altering the customary smoking experience and satisfaction.

40 Claims, 4 Drawing Sheets

CIGARETTE MANUFACTURING PROCESS

BACKGROUND OF THE INVENTION

This is a continuation-in-part of copending application Ser. No. 07/149,482, filed Jan. 28, 1988, which is a continuation-in-part of application Ser. No. 921,823, filed Oct. 21, 1986, which is a continuation of Ser. No. 834,129, filed Feb. 26, 1986, now abandoned, which in turn is a continuation of Ser. No. 506,824, filed Jun. 23, 1983, now abandoned, and the '823 application is also a continuation-in-part of application Ser. No. 084,798, filed Aug. 13, 1987, which in turn is a continuation-in-part of above-mentioned Ser. No. 921,823. The entire contents of each of these applications are hereby incorporated by reference.

This invention relates to tobacco smoking articles and their construction, and also to methods for reducing the health risks of smokers. It further is concerned with processes for manufacturing cigarettes and cigarettes made by those processes.

It is known that tobacco and, more particularly, tobacco smoke contain numerous potential carcinogens and cocarcinogens. *Accounts of Chem. Res.*, S. Hecht et al., 12: 92–98 (1979). *Cancer Research*, D. Mocoy et al., 41,2849–2854 (1981). (These and each of the other articles, patents and other documents and publications mentioned anywhere in this disclosure are hereby incorporated by reference in their entireties.) Some of these potential carcinogens and cocarcinogens are tobacco specific; that is, they are associated with and are introduced only by the use of tobacco. In fact, nearly all N-nitrosamines in tobacco products are carcinogenic. See International Agency for Research on Cancer (1978), *N-Nitrosproline and N-nitrosohydroxyproline In: IARC Monographs on the Evaluation of the Carcinogenic Risk of Chemicals to Humans*, Vol. 17, *Some N-Nitrosamines*, Lyon, pp. 303–311; U.S. Department of Health and Human Services (1982), *The Health Consequences of Smoking: Cancer* (*DHHS*(*PHS*) 82-50179), Washington, D.C., U.S. Government Printing Office; Hecht, S.S., Castonguay, A., Rivenson, A., Mu, B. & Hoffman, D. (1983). "Tobacco-specific nitrosamines: carcinogenicity, metabolism and possible role in human cancer", *J. Environ. Sci. Health, Cl*, 1–54. It is also known that N'-Nitrosonoronicotine (NNN) is one of the major tobacco-specific carcinogens occurring in tobacco and also in the particulate phase of tobacco smoke. *N-Nitroso Compounds in the Environment: IARC Scientific Publication*, No. 9, pp. 159–165, D. Hoffmann et al. (1975). See also, *Studies on the Reduction of Nitrosamines in Tobacco*, W. J. Chamberlain et al., Tobacco Science 81 (1981). "It is known that N-nitroso derivatives of tobacco alkaloids, such as N'nitrosornicotine (NNN) and 4-N-methyl-N-nitrosamino)-1-(3-pyridyl)-1-butano (NNK) are powerful environmental carcinogens." See also S. S. Hecht, et al., *Tobacco-Specific Nitrosamines: Formation from Nicotine In Vitro and During Tobacco Curing and Carcinogenicity in Strain A Mice*, J. Natl. Cancer Inst., Vol. 60, No. 4, Apr. 1978, pp. 819–824.

Other related nitrosamines such as N-Nitrosopyrrolidine (NPYR) are found in cooked bacon and other processed meats, as well as in tobacco and tobacco smoke. *IARC Science Publication*, D. Harvey et al., 17: 313 (1978). Hence, nitrosamines can arrive in the environment from several sources.

Recent experimentations with NNN have left little doubt that this compound is a potent carcinogen or pre-carcinogen in mammals. By administering NNN in drinking water, esophageal tumors have been induced in F-344 rats. *Carcinogenesis*, S. Hecht et al., 3: 453–456 (1982). Further, administration of NNN is also known to induce carcinogenesis in the olfactory epithelium, lung, salivary glands of rodents. See *Cancer Research*, W. Waddell et al., 40: 3518–3523 (1980). Moreover, the presence of a metabolite of NNN at the sites of tumor formation has been confirmed by radio labelling experiments. A whole-body autoradiography study of adult male C57BL/6J mice, utilizing [$^{14}$C]NNN to assess the specific distribution of NNN and its metabolites in all the tissues of the body, revealed a striking correlation of the retention of radioactivity with the previously reported sites of tumor formation. *Cancer Research*, W. Waddell et al., 40: 3518–3523 (1980).

It has interestingly been discovered that NNN exhibits an extraordinary degree of selectivity in inducing tumor formation. More particularly, NNN typically induces tumor formation at five sites, namely the nasal cavity, the salivary duct, the esophagus, the bronchial epithelium and the liver. *Cancer Research, supra*. While the precise method of NNN carcinogenesis is unclear, there is evidence that the proximal carcinogen is formed following the a-hydroxylation of NNN in vivo. *Cancer Research*, C. Chen et al., 38: 3639–3645 (1978); *Cancer Research*, W. Waddell et al., 40: 3518–3523 (1980). Experimentation has indicated, for example, that the F-344 rat esophagus, in contrast to other tissues, preferentially catalyzes hydroxylation at the a-carbon of NNN adjacent to the pyridine ring. *Carcinogenesis*, S. Hecht et al., 3: 453–456 (1982). Thus, the selective retention of NNN and metabolites thereof in sites where tumor formations are known to occur preferentially allows an excellent correlation of molecular accumulation with carcinogenic activity. However, despite the increasingly strong nexus between the tumor incidence, reactive nitrosamines such as NNN continue to be ubiquitous in the environment, especially occurring in the tobacco smoke stream.

A number of proposals have been made to reduce the amount of undesirable substances inhaled by the smoker in the smoke stream. Generally, these proposals fall into three categories. The first category pertains to methods for reducing the irritant material itself, generally through changes in tobacco blends, by special growing, processing or extraction, by the partial or total replacement of the tobacco with tobacco substitutes, or by varying the tobacco's combustion temperatures. The second category is concerned with the dilution of the smoke before it enters the smoker's mouth, as for example by the use of highly permeable cigarette paper or filter paper or by the perforation of the cigarette filter to allow air to be drawn directly into the smoke stream. The third category of proposals deals with the construction of the filter itself to achieve the high filtration or the selective removal of particulate matter.

While many of these proposals, individually or in combination, have been successfully commercialized, each reduction of the tar and nicotine yield and of irritating substances is accompanied by a corresponding reduced level of the resulting smoker satisfaction. Even the recently introduced so-called smokeless cigarettes have disappointed many analysts and smokers since they vary the customary smoking pleasures and routines. Further, although many substances have been isolated as carcinogenic, gross reduction of tar and nicotine yields and gross reduction of irritating substances do not selectively reduce the isolated carcinogen because these proposals do not selectively or effectively isolate these carcinogens. Recent sales date indicate that, despite various products purporting unique methods of maintaining taste satisfaction at reduced levels of tar and nicotine and irritant deliveries, sales of lowered tar and nicotine and irritant products, particularly those commercially classified as "ultra low tar and nicotine" products, are decreasing. Further in accordance with the preceding, the practical deficiency of products purportiong to selectively or grossly remove substantially all of an isolated carcinogenic material is evidenced by recent data which indicates that long-term cancer incidences have not, as one would have expected from the adoption of such products, been reduced but, rather, have increased. While reducing a smoker's health concerns is of vital importance, many smokers at some reduced tar and nicotine level switch back to a higher tar and nicotine cigarettes, thereby invalidating their intended health benefits. Also, some smokers of the low tar and nicotine cigarettes have compensated by smoking more cigarettes or by more deeply inhaling the smoke of these cigarettes.

Additionally, no known cigarette or cigarette filter designs preferentially reduces or filters out any chemical compound, in particular, any carcinogens. Known cigarettes and cigarette filters also do not discriminate as to particulate matter or carcinogens.

To reduce the production of undesirable smoke components according to another known procedure the tobacco is homogenized and reconstituted into a suitable paper form after extraction or treatment. Since the flavors are not thereby fully reconstituted this transformation procedure has resulted in a marked reduction in the acceptability of these cigarettes.

Clearly then, the practice of reducing either tar and nicotine and irritant content is severely limited in terms of the efficacy thereof for reducing irritants to which a smoker is exposed or for reducing the smoker's continued exposure to the health risks associated with carcinogenic matter found in the smoke stream. This is evidenced by the smoker's dissatisfaction with ultra low levels of tar and nicotines due to unacceptable low taste satisfaction. It is further accepted that mere gross reductions in smoke stream constituents at the very least fail to reduce the isolated carcinogens below a concentration in the smoke stream that would be non-toxic, and, in the case of eliminating isolated carcinogens, is a deficient course of action.

SUMMARY OF THE INVENTION

Accordingly, it is a primary object of the present invention to provide a novel cigarette construction which does not adversely effect or detract from the smoking satisfaction but does selectively reduce some specific associated health concerns and risks.

Another object of the present invention is to provide a novel smoking tobacco product which does not require the smoker to vary his normal smoking regime and which does not compromise the structure of the smoking tobacco product over the normal course of the manufacture, distribution, storage and handling of it.

A further object of the present invention is to provide a smoking tobacco product or article which inhibits in a non-toxic manner the selective localization of nitrosamines and metabolites thereof in the smoker's respiratory tissues.

A still further object is to provide for the addition of a substance to a tobacco smoking product which reduces the smoker's health risks from exposure to the tobacco smoke but does not require any varied manipulation of the product as it is being smoked.

Another object is to provide a novel cigarette construction which provides for the blocking of the localization of NNN in those inhaling the cigarette smoke and which can be manufactured according to current high speed rates of production of about 1,000–8,000 cigarettes per minute.

A further object is to provide a novel method of inhibiting the selective localization of nitrosamines and metabolites thereof from tobacco smoke in the tissues of a smoker (or those around him), and more particularly NNN and metabolites thereof.

A still further object is to provide a novel tobacco smoking article which does not reduce the presence of any substance in the smoke stream or require a reduction in the tars and nicotines and irritants therein, but does reduce the smoker's associated health risks.

Another object is to provide a cirgarette having a unique cigarette additive which is invisible to the eye and does not change the size, shape and feel of the cigarette, and thereby increases the likelihood that the cigarette will be purchased and smoked.

A further object is to provide a method of manufacturing cigarettes which offer smokers a new and significant reduction in their health risks and fully maintains the smoking satisfaction provided by today's cigarettes.

A still further object is to provide an improved cigarette construction which provides full smoker approval and is in line with current science.

Another object is to provide an improved and novel method for delivering vitamins, and particularly Vitamin A, into the mouths and respiratory tracts of cigarette smokers.

A further object is to provide a process for manufacturing cigarettes which impose reduced health risks to the smokers thereof, and which do not suffer from significant loss of shelf life, stability, appearance and smoking pleasure.

A still further object is to provide an improved cigarette construction which can be run with little, if any, modification to the making lines in existing cigarette manufacturing facilities.

Another object is to provide an improved cigarette construction which adds no harmful vapors to the smoke stream thereof.

A further object is to provide an improved cigarette construction which reduces associated health risks without varying the customary cigarette taste, mouthfeel, handling and burning characteristics which smokers have come to expect.

A novel application of a blocking agent is proposed by this invention that has the effect of neutralizing the tobacco-specific nitrosamines without the problem of taste unacceptability associated with previous efforts to isolate and specifically remove carcinogenic compounds. This invention discloses a means of selectively blocking the biological activity of this carcinogen in the identified organs of the smokers's body. Rather than a reduction of any element in the smoke stream, the introduction of a blocking agent in the smoke stream is thus called for herein. Remarkably, this blocking agent appears to be active only when in contact with the specific cell-receptors on or in the identified organs of the smokers's body. Since there is no need for any reduction of the tar and nicotine content of the particular brand of cigarette smoked, there is no associated reduction in smoker taste satisfaction. Although many processes for incorporating the blocking alcohols in cigarettes, for example, are possible and are discussed herein in detail, a preferred process is to spary the alcohol(s) on the redried cut rag tobacco during the cigarette making procedure.

Other objects and advantages of the present invention will become apparent to those persons having ordinary skill in the art to which the present invention pertains from the foregoing description taken in conjunction with the accompanying drawings.

GENERAL DISCUSSION OF THE INVENTION

Figure 1:
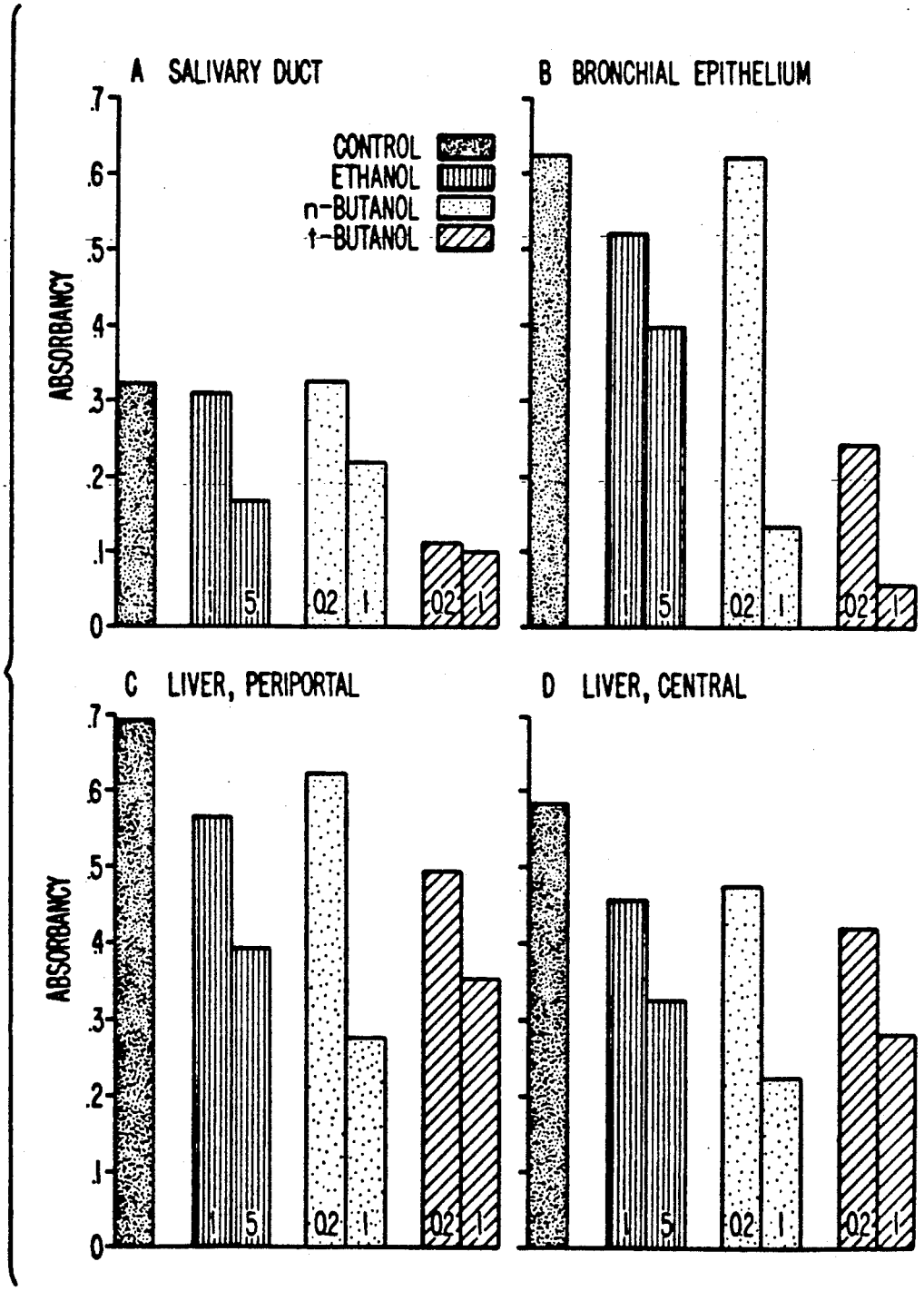
FIG. 1 is a bar graph representation of inhibition test results for the present invention.

According to the present invention, a tobacco smoking product or article has been discovered whereby the selective localization of nitrosamines, such as NNN and metabolites thereof, in at least three of the mammalian tissues in which these compounds are known to accumulate is inhibited by additives in the tobacco smoke stream. These tissues are the bronchial epithelium, the salivary duct epithelium and the liver, and not coincidentally, these are the same mammalian tissues in which nitrosamines, such as NNN and metabolites thereof, appear to function as carcinogens.

NNN is one of the most abundant carcinogens found in cigarette smoke, and cancerous tumors form where NNN accumulates such as in the lung. While th actual biochemical process involved herein has not yet been precisely determined, the NNN alcohol blockers of this invention are thought to work in one of the following ways: either the blocking molecules bind with surface cell receptors of the tissue cells at the sites of localization of NNN, such as in the lung, liver and salivary duct, thereby preventing the binding of NNN and its carcinogenic metabolites; or, alternatively, the blocking molecules bind with cell receptors within the tissue cells at these sites, either blocking or altering the process by which NNN is metabolized within the cell and thereby preventing the formation of the carcinogenic metabolites of NNN. In other words, the blocking molecules have the effect of either "jamming the lock" (the cell receptor) and preventing the "NNN key" (the molecule) from entering, or altering the "NNN key" so that it will no longer fit in the "lock". Unable to enter or dock in the tissue, the NNN then passes harmlessly out of the lung.

The present invention then is directed to methods for inhibiting the selective localization of nitrosamines and metabolites thereof in mammalian tissues, and not to the treatment of tumors. In other words, the subject invention is not directed to the treatment of tumors or cancers but rather is concerned with delocalizing nitrosamines and metabolites thereof, i.e., chemicals, which tend to selectively localize in mammalian tissue. In fact, the tobacco smoking products or articles of the present invention can be effective particularly where tumors are not present.

Surprisingly, it has been discovered that certain alcohols inhibit this selective localization of nitrosamines, such a NNN and metabolites thereof. The alcohols which are operable according to the invention include alcohols having two or more carbons. However, it is preferable to use alcohols having alkyl groups of at least three carbons or greater. The alkyl groups may have a straight chain or a branched chain structure. Moreover, the alkyl groups may have a cyclic or acyclic structure. Examples of alcohols which may be used are ethanol, n-propanol, isopropanol, n-butanol, sec-butanol, isobutanol, t-butanol, 2-methyl-1butanol or "active" amyl alcohol, n-amyl alcohol, sec-amyl alcohol, t-amyl alcohol, n-hexyl alcohol and cyclohexanol. Other chemical compounds which have also been found to delocalize nitrosamines are dimethylsulfoxide (DMSO), imidazole, pyrazole, diethyldithiocarbamate, and benzylisothiocyanate. These and other alcohols and compounds of the present invention are listed below in Tables I and VI. A preferred alcohol of this list when delivered in the tobacco smoke stream are the cyclohexanols as they add little taste to the smoke and have a pleasant odor. It has been specifically noted that the alcohol menthol does not inhibit nitrosamine localization as do the compounds encompassed by this invention.

Table I

The present invention covers all monohydric and polyhydric alcohols and compounds with a resonant hydroxyl species of from two to forty carbon atoms including, but not limited to, the following:

| MONOHYDRIC ALCOHOLS: POLYHYDRIC ALCOHOLS: |
|---|
| Ethyl alcohol |
| n-Propylaclohol |
| Isopropyl aclohol |
| Allyl alcohol |
| Crotyl alcohol |
| n-Butyl alcohol |
| Isobutyl alcohol |
| sec-Butyl alcohol |
| t-Butyl alcohol |
| 2-pentanol |
| 3-pentanol |
| n-Amyl alcohol |
| Isoamyl alcohol |
| t-Amayl alcohol |
| 2-methyl-1-butanol |
| 3-methyl-2-butanol |
| Neopentyl alcohol |
| Cyclopentanol |
| n-Hexyl alcohol |

-continued

| |
|---|
| 2-hexanol |
| 3-hexanol |
| 2-methyl-1-amyl |
| 3-methyl-1-amyl |
| Cyclohexanol |
| n-Octyl alcohol |
| Capryl alcohol |
| n-Decyl alcohol |
| Lauryl alcohol |
| Myristyl alcohol |
| Cetyl alcohol |
| Stearyl alcohol |
| Benzyl alcohol |
| Benzhydrol |
| Cinnaryl alcohol |
| Triphenylcarbinol |
| Ethylene glycol |
| 1,2-Propanediol |
| 1,3-Propanediol (tri-methylene glycol |
| 1,3-Butanediol |
| 1,4-Butanediol |
| 2,3-Butanediol |
| 1,5-Pentanediol |
| 1,6-Hexanediol |
| 1,10-Decanediol |
| Pinacol |
| Glycerol |
| 1,2,4,Butanetriol |
| 1,2,5-Hexanetriol |
| COMPOUNDS WITH RESONANT HYDROXYL SPECIES: |
| Dimethyl-Sulfoxide (DMSO) |

The amount of alcohol which is applied may be any amount which is greater than the threshold amount needed to effect nitrosamine delocalization in the affected mammalian tissues, but less than an amount which would produce any toxic side effects in the mammal. For oral administrations of the alcohols of the present invention, about 1 ul of an alcohol is used per gram of mammalian body weight. The amounts of alcohols contemplated for use by inhalation herein fall far short of the dosages required for toxic effects. Also, the higher alcohols have low toxicity; their toxic effect is restricted to the sedation of the central nervous system. Table II below summarizes the toxicological properties of some typical alcohols. *Kirk-Othmer: Encyclopedia of Chemical Technology*, Vol. 1, at 727 (1978), and *The Registry of Toxic Effects of Chemical Substances*, U.S. Department of Health, Education and Welfare, Vol. 2(1977).

TABLE II

| Alcohol | Acute Oral $LD_{50}$[1]rats q/kg |
|---|---|
| ethanol | 14 |
| n-propyl | 5.4 |
| isopropyl | 5.84 |
| n-butyl | 0.79 |
| isobutyl | 2.46 |
| t-butyl | 3.5 |
| n-amyl | 3.03 |
| sec-amyl | 1.47 |
| iso-amyl | 1.30 |
| t-amyl | 1.0 |
| hexyl[b] | 3.7 |
| cyclohexyl | 2.06 |
| "active"-amyl (e.g. 2-methyl-1-butanol) | 4.9 |
| retinol | 2.0 |
| menthol | 3.18 |
| 4-methyl-2-pentanol | 2.6 |
| 2-ethyl hexanol | 3.2–7.1 |
| isoctyl[b] | 1.5 |
| decyl[b] | 4.7–9.8 |

TABLE II-continued

| Alcohol | Acute Oral $LD_{50}$[1]rats q/kg |
|---|---|
| dodecanol, 98% (coconut derived) | 40 |
| hexadecanol | 20 |
| octadecanol | 20 |

[a]The dose resulting in the death to 50% of the test animals, expressed in terms of g of materials per kg of body weight.
[b]mixed isomers.

The values for acute oral toxicity may be compared to an $LD_{50}$ of about 3.75 g/Kg for sodium chloride with rats. A substance with an $LD_{50}$ of fifteen g/KG or above is generally considered to be nontoxic. By comparison, the estimated acutely fatal oral dose of nicotine, present in tobacco, for an adult human is one mg/kg of body weight. *Principles of Internal Medicine*, Harrison 9th Edit., Section 18 (1975). Thus, as the alcohols of the present invention are used in dilute aqueous solutions, one skilled in the art can easily achieve the desired delocalization effect of the present invention while avoiding the toxic side-effects of an overdose.

In addition to introducing potential carcinogens by smoking, smoking has also been linked with the depletion of certain B vitamins in the smoker. Furthermore, Vitamins C and E have been shown to prevent the formation of nitrosamines on epithelial membranes; in addition, Vitamin A and retinoids inhibit tumor development. Selenium and other agents also inhibit tumor development. *Inhibition of Tumor Induction and Development*, N. S. Zedeck, M. Lipkin, Prenum Press, N.Y. 1981. Hence, it is within the scope of the present invention to combine the alcohols with various vitamins and other agents which are known to be depleted by smoking, to inhibit nitrosamine formation or to inhibit tumor development. Moreover, the amounts to be used of such vitamins or other agents such as selinium would in view of the subject disclosure be within the knowledge and abilities of one skilled in the art. *Inhibition of Tumor Induction and Development, supra.*

Examples of the present invention are now provided for purposes of clarity. However, it is understood that these examples are in no way intended to limit the scope of the present invention.

EXAMPLE 1

Adult male, C57BL/6J mice were injected intravenously with 0.12 to 0.19 uci/g body weight, corresponding to a dose of 0.4 to 1.9 mg/Kg of [2′−$^{14}$C]NNN (New England Nuclear; Spec. Act. 18.4 or 51.7 mCi/mmol). One hour later, the mice were anesthetized lightly with ether and frozen by immersion in dry ice/hexane. Twenty u-thick whole-body sagittal sections of the frozen mice were taken onto Scotch tape and were then processed for whole-body autoradiography by known methods. See W. Waddell et al., *Drug Fate and Metabolism: Methods and Techniques*, E. R. Garrett and J. L. Hirtz, Eds. (Marcel Dekker, New York, 1977 at p 1–25). Photometric density in areas of the developed autoradiographs was measured with an ADG Instruments photometer and a photocell with an aperture of three mm lying on the easel of a photographic enlarger. The X-ray film was placed in the enlarger and raised to produce a magnification of thirty-five times on the easel.

Aqueous solutions of ethanol, n-butanol and t-butanol were administered by oral intubation to some of the mice twenty minutes before receiving the [$^{14}$C] NNN.

Ethanol (1 g/Kg and 5 g/Kg) and n- and t-butanol (0.2 g/Kg and 1 g/Kg) solutions were prepared so that each mouse received 0.02 ml/g body weight. (Twenty minutes is the average time it takes for alcohols introduced by oral intubation into mice to reach the peak blood level.)

The autoradiographs revealed that the localization of radioactivity in salivary duct and bronchial epithelium and in both periportal and central areas of the liver was reduced by applying ethanol (a chemopreventative agent of this invention) and to a greater extent with n-butanol. At the high dosage, t-butanol almost completely abolished the localization of [$^{14}$C] NNN in bronchial epithelium. Furthermore, the reduction in photometric density was dose related. FIG. 1 shows the absorbancies of the areas measured with the densitometer. Control experiments were conducted for comparison.

More particularly, FIG. 1 shows the means of the absorbancies from the photometric densitometer for the four areas in which inhibition of localization of radioactivity was seen. The number within each bar thereof represents the dose in g/kg of that alcohol which was administered orally twenty minutes before the [$^{14}$C] NNN was given intraveously. The mice were frozen one hour after receiving the [$^{14}$C] NNN. The means for each mouse were from fifteen measurements on random areas of that site (five absorbancies on each of three autoradiographs) after setting blood in each on zero. The control valve is the mean from six mice; the n-butanol at 1 g/kg is from two mice; the other means are from one mouse. The coefficient of variation of each mean was less than ten percent. All measurements were made at one occasion by the same observer who had no knowledge of the treatment of each randomly selected autoradiograph.

Further details and explanation of Example 1 are set forth in the article authored by William J. Waddell, M.D. and Carolyn Marlowe, entitled "Inhibition by Alcohols of the Localization of Radioactive Nitrosonornicotine in Sites of Tumor Formation," Science, Vol. 221, pp. 51–53, Jul. 1, 1983. A recent article relative to the metabolism of NNN in the liver is M. F. Hughes et al., "Characterization of covalent binding of N-nitrosonornicotine in rat liver microsomes", *Carcinogenesis*, Vol. 7. (1986).

EXAMPLE 2

An adult C57BL/6J mouse was placed in a beaker with an elevated screen floor which had two ml of cyclohexanol beneath the floor on the bottom of the beaker, and the top of the beaker was then covered with foil. The mouse was kept in the closed beaker for about five minutes as the bottom of the beaker was maintained at 50° C. in a water bath. By referring to standard tables, it was calculated that at 50° C. the vapor pressure of cyclohexanol imparts an alcohol concentration of 0.01% in the air in the beaker. *Handbook of Chemistry and Physics* (1979), at D-203 to D-217.

After five minutes in the beaker, the mouse was injected intravenously with 0.12 and 0.19 ucu/g body weight, corresponding to a dose of 0.4 to 1.9 mg/kg of [2'-$^{14}$C] NNN (New England Nuclear; Spec. Act. 18.4 or 51.7 mCi/Mmol). One hour later, the mouse was anesthetized lightly by ether and frozen by immersion in dry ice/hexane. Twenty u-thick whole-body, sagittal sections of the frozen mouse were taken onto Scotch tape and processed for whole-body autoradiography as in Example 1. No radioactivity was detected in any part of the bronchial epithelium. Control experiments were conducted for comparison purposes and radioactivity was detected in the respiratory epithelium in the controls.

EXAMPLE 3

Example 2 was duplicated, except that the mouse was kept in the closed beaker for five minutes as the bottom of the beaker was maintained at 26° C. in a water bath. By referring to standard tables, it was calculated that at 26° C. the vapor pressure of cyclohexanol imparts an alcohol concentration of 0.001% in the air in the beaker. After injection as in Example 2, the mouse was processed in the same manner as in Example 2. No radioactivity was detected in any part of the bronchial epithelium in contrast to the control experiment.

EXAMPLE 4

An adult male C57BL/6J mouse was injected intraperitoneally with 0.02 ml/g body weight of a solution of imidazole in water. The imidazole solution concentration was such that 0.05 g of imidazole was delivered per kg of body weight. Twenty minutes after injection, the mouse was injected intravenously with 0.12 to 1.9 uci/g body weight, corresponding to a dose of 0.4 to 1.9 mg/kg of [2'-$^{14}$C] NNN (New England Nuclear; Spec. Act 18.4 or 51.7 mCi/mmol). One hour later, the mouse was anesthetized lightly with ether and frozen by immersion in dry ice/hexane. Twenty u-thick whole-body, sagittal sections of the frozen mouse were taken onto Scotch tape and the sections were then processed for whole-body autoradiography by known methods. See Example 1. Significant nitrosamine delocalization was discovered in the mouse injected with the imidazole solution relative to that in the control mouse.

EXAMPLE 5

Example 4 was duplicated except that the adult mouse was injected intraperitoneally with 0.02 ml/g body weight of a solution of imidazole in water, wherein the solution concentration was such that 0.25 g of imidazole was delivered per kg of body weight. After conducting the rest of the experiment as in Example 3, significant delocalization of nitrosamine was found in the mouse injected with the imidazole solution relative to that in a control mouse.

From inspection of FIG. 1, the greatest inhibition was observed with the t-butanol in bronchial epithelium. The reductions were similar in both areas of the liver for all three alcohols at the doses used. There were no significant differences between the control and treated groups in the absorbancies in nasal and esophageal epithelium. The results strongly suggest that the use of an alcohol of this invention as a chemopreventative agent inhibits the localization of the proximal carcinogen in bronchial and salivary duct epithelium and in liver, but not in nasal and esophageal epithelium, in male, C57BL/6J mice. On a molar dose, t-butanol has approximately fifty times the potency of ethanol in inhibiting the localization in bronchial epithelium.

The specificity of inhibition in some sites suggests that one of several mechanisms may be involved. One mechanism which may be involved is a competitive inhibition mechanism with either secondary alcohol dehydrogenase or cytochrome P-450$_{LM3a}$ being involved. With either of these systems, it is thought that the alcohols of the present invention might compete successfully with the a-hydroxy NNN substrate to prevent the formation of the proximal carcinogen. While it is possible that a simple solvent effect may be involved, the site specificity and marked potency differences of the alcohols strongly favor metabolic inhibition.

Another possible explanation for the invention is set forth as follows. It is generally accepted that covalent modification of DNA by chemical carcinogens, or their metabolites, is the key step in the initiation of the carcinogenic process (S. S. Hecht, *Chemical Carcinogensis: An Overview*, Drug Mechanisms, 8th Annual Meeting, NACB, Washington, D.C., 1984, Clin. Physiol, Biochem., 3:89–97, 1985). DNA bases have many nucleophilic sites which readily react with electron deficient, or electophilic, carcinogen metabolites (Hecht; E. J. LaVoie, S. S. Hecht, *Chemical Carcinogens: In Vitro Metabolism and Activation*; in Hazard Assessment of Chemicals, Current Developments, Vol. 1, pp. 155–169, Academic Press, New York, 1981). The conversion to an electrophilic metabolite that reacts with DNA is, accordingly, the unifying property among the many structurally diverse chemical carcinogens (Hecht).

The metabolic pathway of the TSNA's NNN and NNK have been studied in rats and hamsters (U.S. Department of Health, *The Health Consequences of Smoking, A Report of the Surgeon General*, 1982) and in the marmoset monkey (A. Castonguay, H. Tjalave, N. Trushin, R. d'Argy and G. Sperber, "Metabolism and Tissue Distribution of Tobacco Specific N-Nitrosamines in the Marmoset Monkey," *Carcinogensis*, Vol. 6, No. 11, pp. 1543–1550, 1985). The metabolic activation of NNN and NNK in rats, hamsters and monkeys most likely starts with a-carbon hydroxylation (U.S. Dept. of Health; Castonquay). The initial hydroxylation is likely mediated by the cytochrome P-450 oxidase system (M. F. Hughes, W. J. Brock, L. J. Marion and M. Vore, "Characterization of Covalent Binding of N-Nitrosonornicotine in Rat Liver Microsomes," *Carcinogensis* 7(1): pp 3–8, 1986; Hecht). The electrophilic diazohydroxide intermediates of NNN and NNK are identical (U.S. Dept. of Health). These electrophilic intermediates, or the resulting carbonium ions, are probably the ultimate carcinogenic form of TSNA's (U.S. Dept. of Health). The electrophilic intermediates or the cabonium ions then react with the DNA to form the TSNA-DNA binding adduct.

Autoradiographic and biochemical reports have shown that the metabolites of NNN and NNK bind to macromolecules of the tracheobronchial and nasal mucosa and to the kidney, liver, sublingual and sumauxillary glands, esophagus and melanin of the eye (U.S. Dept. of Health). This organ specific binding may come about by the mediation of a second enzyme interaction. This secondary mechanism is poorly understood, however. To date, no study has characterized the liver microsomal enzyme—mediated binding of TSNA's to tissue of nucleophiles (Hughes). There have been no studies of other organ specific enzymes and their mediated binding of TSNA's to tissue nucleophiles.

It is believed, however, that the blocking compound or alcohol of this invention interrupts the ordinary metabolism of the TSNA. In any event, it is not necessary to restrict the present invention by basing it on any particular theory.

In order to inhibit the selective localization of nitrosamines, such as NNN and metabolites thereof, the alcohols of the present invention can be administered by several different techniques. However, the means of application must be able to accomplish four objectives, namely, (1) delivery of the alcohol in high concentration only or primarily to the desired sites of action, e.g., the respiratory epithelium, (2) delivery only during the time interval of maximal exposure to the smoke, (3) delivery only or primarily to the smoker and (4) minimal exposure of other organs in the smoker's body to the inhibitory substance. The present invention is directed particularly to constructions of tobacco smoking products for delivering the alcohols in the tobacco smoke stream to the smoker and which fulfill these objectives. It is more particularly directed to cigarettes which fulfill these objectives and to processes for manufacturing those cigarettes.

DETAILED DESCRIPTION OF PREFERRED EMBODIMENTS OF THE INVENTION

There are a variety of techniques by which these four objectives can be satisfied while achieving nitrosamine delocalization. For example and generally speaking, the alcohols can be encapsulated in rupturable capsules filled with one or more alcohols of this invention and mixed with tobacco prior to smoking, as in a pipe, or the rupturable capsules can be placed directly in the tobacco or filter of a cigar or cigarette during the manufacture thereof. Alternatively, the rupturable capsules can be placed inside a disposable filter which can be placed on a cigar or cigarette, or a disposable smoke filter having a cylindrical body of plastic or paper which contains rupturable capsules containing one or more alcohols of the present invention can be provided. It is also within the scope of the invention to use any combination of the alcohol placement or fixation mechanisms mentioned or suggested herein within a single tobacco smoking article or product, e.g., cigarette.

One method for delivering these alcohols in the smoke stream of a tobacco article is to microencapsulate the alcohol and then to position the microcapsules within the article. It is noted that encapsulation initially isolates the alcohol and provides for the controlled release thereof so it can then interact with its smoke stream environment. The shell wall microencapsulation construction should be sufficiently compatible with the alcohol contained therein to retain the alcohol until such time as the heat of the smoke causes the shell to open. In other words, the microcapsule is stable within the cigarette until it is smoked and then is heat triggered and the alcohol therein controllably released. Encapsulation that melts, as opposed to volatizes, prevents the introduction into the smoke stream of vapors which are ordinarily a by-product of the volatilization of the shell wall. The alcohols are thereby automatically released for the convenience of the smoker so that he does not have to further manipulate the smoking product, and so to ensure a more consistent release.

Figure 2:
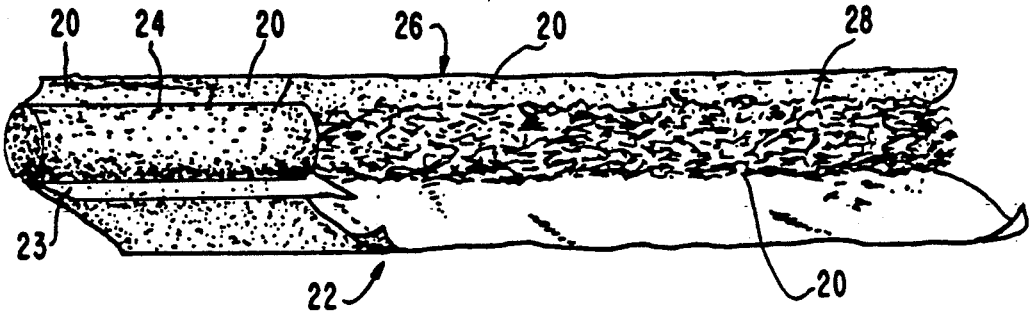
FIG. 2 is a perspective view of a first embodiment of the present invention.

As shown in FIG. 2, these microencapsulated alcohols 20 can be placed in the cigarette shown generally at 22, the plug wrap 23, the acetate filter 24, and/or the cigarette tobacco rod 26 thereof mixed evenly into the cut rag tobacco 28. The dosage is determined by the time weighted average (TWA) (for a normal eight hour work day and forty hour workweek) of the alcohol in the human such that sufficient alcohols are delivered to block the cell receptors with little waste or excess delivery. The dosage may also be varied according to the blend variables such as low tar blends, ultra low tars, full flavor blends, menthol blends and blends of the various branded cigarettes.

A shell wall construction referred to as the M-CAP Process of Insulation Technologies Corporation of Darby, Pennsylvania can be used. The general specification of the M-CAP shell walls are capsules as small as three microns with melt temperatures of sixty-four to six hundred and fifty degrees Fahrenheit. The rate of controlled release should generally be constant but it can be varied. More particularly, capsules with varied melt temperatures can be included in a single cigarette to ensure a constant release of the alcohols therein as the coal burns down the tobacco rod and the higher temperatures impact the filter section thereof. Where the rate control is designed to vary, the shell material, thickness and/or capsule size can be accordingly varied. The M-CAP construction provides for uniform capsule size and for capsules smaller than fifty microns.

The encapsulation material of the shell wall can be ELVAX (ethylene/vinyl acetate copolymers) or a similar cellulite material having the desired characteristics of a programmable shell wall release temperature of between sixty-four and six hundred and fifty degrees Fahrenheit. ELVAX is an ethylene vinyl acetate resin, such as described in the "Material Safety Data Sheet - VAX001," dated 10/20/86, of E. I. DuPont de Nemours & Co. (Inc.) of Wilmington, Del. A second possible shell wall material is EUDRAGIT E, which is a cationic copolymer synthesized from dimethylaminoethyl methacrylate and neutral methacrylic acid ester, and can form a rapidly disintegrating film coating. Other shell well candidates include BERMOCOLL, which is an ethylhydroryethylcellulose manufactured by Berol Kemi AB of Stenungsund, Sweden, and also K & K Gelatin, which is a gelatin manufactured by Kind & Knox, which is a division of Knox Gelatine, Inc., of Saddle Brook, N.J.

N-LOK, which is an emulsion stabilizing material (55-129), is an alternative encapsulating product. A description for it is found in the "Product Data: Bulletin No. 447", of National Starch and Chemical Corporation, Food Products Division, of Bridgewater, N.J.

Another construction of this invention is to encapsulate the blocking alcohol, such as cyclohexanol, in a modified starch material from a slurry bath thereof. An example of suitable such material is CAPSUL, which is described in "Product Data: Bulletin No. 409" of National Starch and Chemical Corporation, Food Products Division, of Bridgewater, N.J. CAPSUL is made from waxy maize, is especially suited for encapsulation, and has exhibited ease of dispersibility of the encapsulated fluid (especially for flavor oils) and excellent shelf-life stability.

The shell wall should comprise between twenty and fifty percent of capsule volume for stability so as to resist rupture in the making, packing and consumer handling of the cigarette. The capsules should be three to ten microns in circumference when placed on the inside of the cigarette paper or when mixed into the tobacco so as to avoid undesired bumpiness on the cigarette paper and to remain invisible if placed in the tobacco. Larger circumferences up to fifty microns are acceptable if the capsules are placed in the cigarette filter. The capsules can be further hardend with a plasticizer to control their melt temperatures. Further, the capsules can be dyed with suitable food dyes to match the color of the cigarette tobacco. It is also within the scope of the present invention to assure further stability by double encapsulating the capsules, as for example by the M-CAP or coacervation processes.

Figure 3:
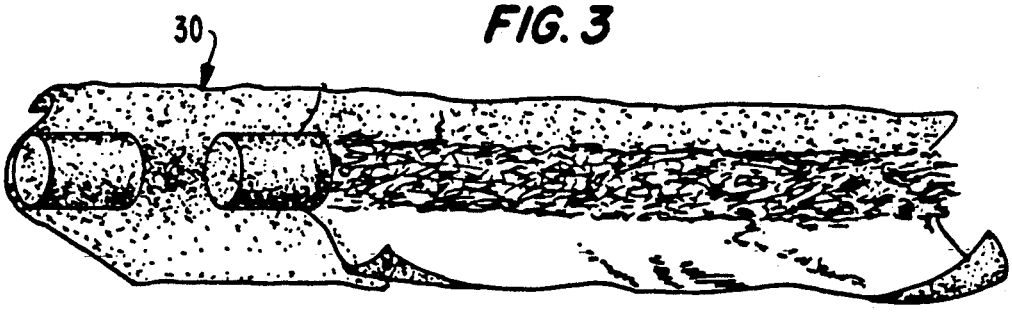
FIG. 3 is a perspective view of a second embodiment of the present invention.

One way of attaching the capsules to the cigarette paper according to one construction of the invention is that disclosed in U.S. Pat. No. 4,236,532. The microencapsulated alcohols can be attached, in addition to the cigarette paper, to the plug wrap or contained in the filter of the cigarette either evenly disbursed or within the center of gravity of a triple gas trap filter construction, as shown generally at 30 in FIG. 3. Such a triple gas trap filter construction can have a plasticized containment system to minimize leakage from the ruptured capsules.

Alternatively, the capsules can be attached to the cigarette paper or plug wrap via a common gelatin or starch paste coating. The capsules may be mixed into the adhesive, and the paper may be coated via a processing through a slurry bath, similar to the method of attachment by carbonless paper. The capsules preferably are positioned in the filter section and not in the tobacco rod to thereby mask any undesirable popping or crackling noises that may be associated with the release of the alcohol.

Figure 4:
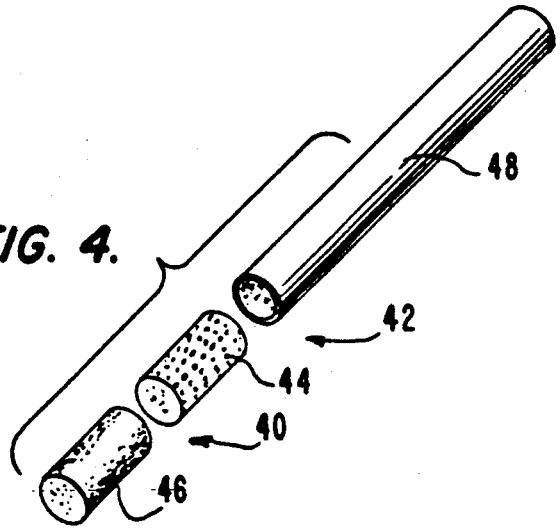
FIG. 4 is a perspective view of a third embodiment of the present invention.
Figure 5:
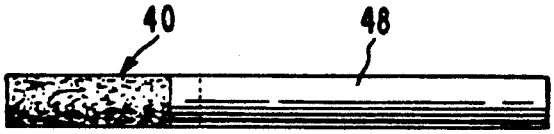
FIG. 5 is a side elevational view of the third embodiment of FIG. 4.

Another delivery mechanism construction of the present invention is a twin filter plug, as illustrated in FIGS. 4 and 5. The twin plug filter section 40 of a cigarette shown generally at 42 is generally twenty to thirty mm in length with twenty-five mm being the most popular length. The twin filter plug 40 is used wherein a ten mm filter pack filter section 44 and a fifteen mm filter section 46 are placed end-to-end in the cigarette section. Each plug is encased in a separate plug wrap and the twin plugs are overwrapped by the plug wrap and then the tipping paper. The ten mm filter pack section 44 is placed against the tobacco rod 48 with the fifteen mm section disposed behind the ten mm section. The ten mm section 44 contains the encapsulated alcohols dispersed uniformly along its longitudinal axis. The capsules can have a circumference and shell wall thickness as described above. The shell wall release temperatures are preferably programmed, as previously mentioned, to be between sixty-five and six hundred and fifty degrees Fahrenheit to ensure a continuous release from the first lower temperature draw of the cigarette through the last draw thereof, which is generally the hottest draw. Flavor enhancers can be added to the ten mm section 44 as part of the encapsulated material. As the smoke steam is drawn through the section 44, the capsule shell walls melt and the encapsulated alcohols are thereby released and then carried by the smoke stream into the section 46, which has a conventional cellulose acetate (tow) construction, for ordinary filtration thereof, before exiting the cigarette 42 into the smoker's respiratory system.

The filter pack section 44 can contain the encapsulated alcohols with the programmed shell walls, flavor reconstitutors, and Vitamin A or other additives as mentioned herein. An example of the inclusion of vitamins is found in U.S. Pat. No. 3,339,558. Additional flavor enhancers can be added, if needed, to reconstitute the desired taste characteristics of the smoke after the smoke has absorbed the blocking compounds. The teachings of U.S. Pat. No. 3,144,024, which illustrates the construction of a filter for use with smoking tobacco which is impregnated with a flavoring composition, can be used to design a device effecting the present invention. This filter section would preferably have all of these materials aligned on the longitudinal axis and dispersed radially therefrom.

It is also within the scope of this invention to add esters and alcohols without encapsulation, or to process the alcohols with an ester.

It is further within the scope of this invention to impregnate the rag tobacco, rolling papers or smoking filters with the alcohols of this invention, and the alcohol vapor is thereby released and inhaled when the item is smoked. The paper wrapper can be dipped in the alcohol and then wrapped around the cigarette before the outer wrapper and foil of each pack is overwrapped. After a few weeks of storage the alcohol will diffuse into the cigarettes. This is similar to a method used to place menthol in cigarettes, and is a very simple, relatively effective and inexpensive technique of this invention. It may also be that this impregnating embodiment would reduce the health concerns and risks associated with passive smoking.

An alternative method of incorporating the alcohol in the cigarette so that it is efficiently released in the tobacco smoke stream and without adversely impacting the cigarette's stability and the resulting smoker satisfaction is to "print" it on the inside of the cigarette paper. More specifically, the gravure printing process can be used to place microcapsules containing one or more alcohols of this invention on the inside of the cigarette paper. By this process an "ink" is created consisting of a slurry medium which contains the microcapsules. The ink is fed into an ordinary printing machine and the printer applies or places the ink on the cigarette paper. An example of an adaptable printing process is that of U.S. Pat. No. 4,236,532.

Figure 6:
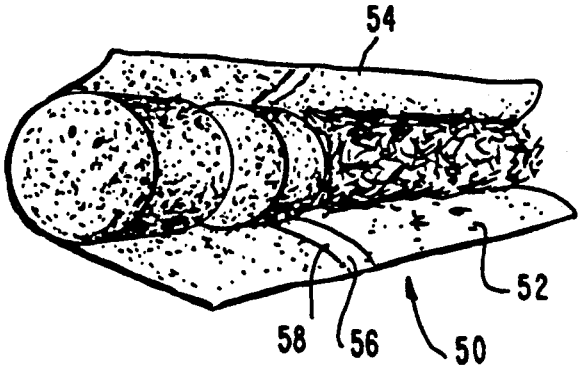
FIG. 6 is a perspective view of a fourth embodiment of the present invention.

As shown in FIG. 6, the microencapsulated alcohols can be coated or implanted in the cigarette 50 on the cigarette paper 52 in strips 54 or randomly throughout, and/or in the tipping paper 56 in strips 58 or randomly throughout the paper, and/or in the barrel wrap in strips or randomly throughout. Alternatively or in combination therewith, as shown in FIG. 2, they can be positioned either randomly or in a predetermined pattern in the filter and/or the rag tobacco. Another method of this invention is to spray the alcohol(s) as by an atomizer in the filter before smoking the cigarette.

Figure 7:
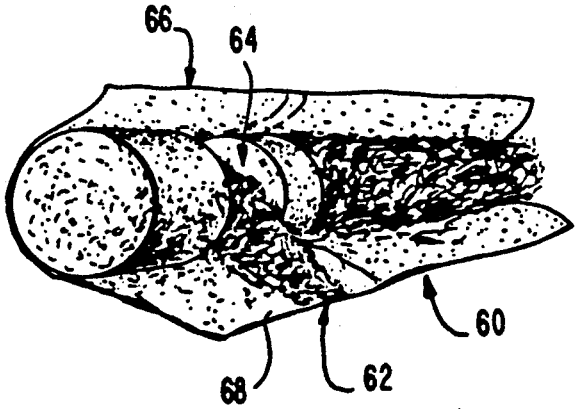
FIG. 7 is a perspective view of a fith embodiment of the present invention.

Yet another mechanism for causing the alcohols to be delivered in the smoke stream of a cigarette 60 is to provide a double gas trap filter as best shown at 62 in FIG. 7. It is seen therein that the central cavity 64 of the filter 66 contains microencapsulated alcohols and/or crystalized alcohols and/or alcohol impregnated charcoals 68 such that the alcohol vapors are released when the cigarette 60 is smoked. The cavity 62 can also be lined with a membrane sufficient to prevent any leakage therefrom or moisture spoilage.

Figure 8:
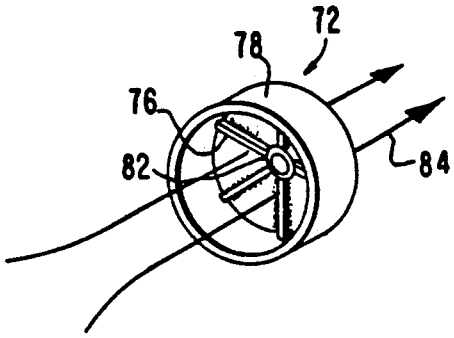
FIG. 8 is a perspective view of a key portion of a sixth embodiment of the present invention illustrated in isolation.
Figure 10:
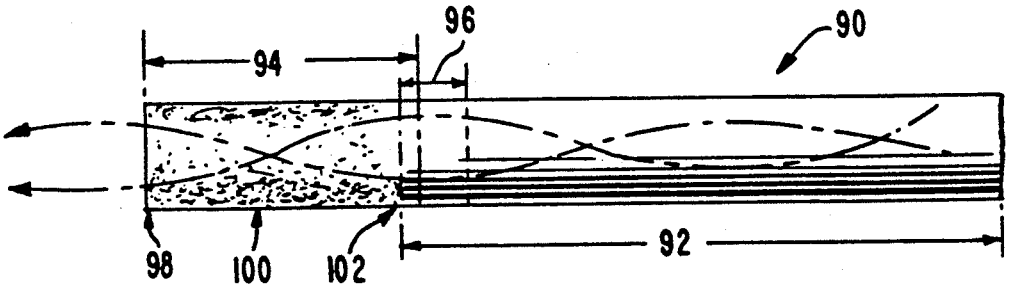
FIG. 10 is a perspective view of a cigarette illustrating the alternative locations for the sixth and seventh embodiments of FIGS. 8 and 9.

The microencapsulated alcohols can also be positioned in the cigarette 70 in a suspension device as shown generally at 72 in FIG. 8. The suspension device 72 can comprise plastic spokes 76 secured to a rigid plastic hub 78 which is flush with the outside circumference of the cigarette barrel. The microencapsulated alcohols 82 are suspended on the spokes 76 and in the hub 78 and released into the smoke stream 84 when the cigarette is smoked. By way of further explanation a typical cigarette 90 including a tobacco rod 92, adjacent filter 94 and overlapping tipping paper 96 is illustrated in FIG. 10. The suspension device 74 can be positioned at any of the locations 98, 100 or 102 as denoted therein.

Figure 9:
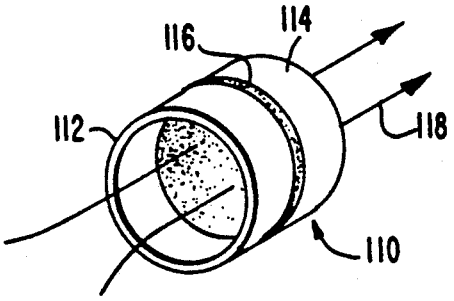
FIG. 9 is a perspective view of a key portion of a seventh embodiment of the present invention illustrated in isolation.

A suction release double trap 15 illustrated in isolation generally at 110 in FIG. 9 may also be inserted at any of locations 98, 100 or 102 of FIG. 10. The double trap 110 comprises a first trap 112, a second trap 114 and a rubberized membrane 116 dividing the traps. The first trap 112 contains the microencapsulated and/or crystalline alcohols, and is sealed on its tip side with the membrane 116. The membrane 116 when ruptured by suction releases the packing of contained alcohols into the second trap 114. The second trap comprises a plastic cell that contains the released alcohols, and provides a maximum surface exposure to the smoke stream 118 of the alcohols and also prevents their leakage from the cigarette.

It is also within the scope of this invention to place the alcohol containing elements anywhere inside the filter including via a large capsule placed inside the filter to be manually or automatically ruptured by other than heat means, as by piercing, squeezing or crushing. See, e.g., U.S. Pat. Nos. 3,547,130 and 3,339,558.

The alcohols may also be contained in a cigarette holder. A holder construction (not shown) can be generally up to three-quarters of the length of the standard, eighty-four millimeter filtered cigarette, and made of plastic. The butt end of the cigarette is secured in an open end of the holder by squeezing or compressing the cigarette to fit in that open end. The other end of the holder tapers down for placement in the smoker's mouth. With generally any available cigarette then fitted into the holder, the blocking alcohol(s) are controllably released from the holder and into the smoke stream as the cigarette is smoked. Reference is hereby made to U.S. Pat. No. 3,713,451 which shows a capsule containing a small fill of aromatic tobacco retained in a mouthpiece positioned adjacent and behind the filter. The hot smoke releases the volatile flavorings within the capsule into the smoke stream as the cigarette is smoked.

The alcohols of this invention can also be administered in a smoking pipe construction (not shown) or special pipe tobacco formulation as would be apparent to one skilled in the art from this disclosure.

The present invention is also an extension of the technology disclosed in International Application No. PCT/US87/01978 of C. A. Blockers, Inc., of Louisville, Ky., entitled "Tobacco Smoking Article." A preferred method of delivering one or more of the blocking alcohols or compounds of the invention, as set forth in that international application, into the smoke stream of a tobacco smoking article, such as a cigarette, is to spray the alcohol(s) onto the redried, cut rag tobacco lead during the manufacture of the smoking article (cigarette) so that the finished cigarette contains the alcohol in its tobacco section or rod. The alcohol preferably should remain stable in the cigarette until the cigarette is smoked at which time the alcohol is heat released into the smoke stream to be inhaled by the smoker. To avoid excessive evaporation, the alcohol is sprayed on the cut rag tobacco during the cigarette manufacturing procedure following redrying, and the alcohol is then allowed to soak into the rag tobacco. Also, to be most effective the amount of alcohol sprayed onto the tobacco must be a quantity sufficient to ensure a transfer of alcohol molecules into the volume of smoke inhaled by the smoker equal to the number of molecules of nitrosamines (or at least the NNN or the NNK molecules) present in that same volume of smoke.

On the other hand, the quantity of alcohol transferred and inhaled by the smoker must be at a safe amount and less than the maximum volumetric concentrations permitted for each alcohol by any applicable government regulation, such as (in the United States) those of the U.S. Occupational Safety and Health Administration (OSHA) Time Weighted Average (TWA). Other helpful guidelines are published by the Flavoring Extract Manufacturers' Association (Generally Regarded As Safe list), and the Hunter Committee from Great Britain. If a substance has not been evaluated in the literature, the toxicity of the substance (alcohol) should be evaluated before use. Compounds or alcohols herein are analyzed individually and the toxicity of a mixture of compounds is assumed to be the toxicity of the most toxic individual substance in the compound. It is expected that 1-1000 micrograms (and more particularly approximately 800 micrograms) of the blocking alcohol(s) would be needed on the rag tobacco for a cigarette containing 400-1200 milligrams (and more particularly approximately 800 milligrams) of tobacco. Yet another way of defining the quantity of alcohol is its concentration in air, which should be about 0.1% to 0.001% (see Example 3, supra).

While the cigarette industry is largely self-regulating as regards additives and materials in the cigarette, manufactures make every effort to determine that new additives are safe for human exposure. There are a number of resources that guide manufacturers. For instance, OSHA has since 1972 tested the maximum exposure limits (TWA) of many common substances in order to determine at what exposure point a substance becomes toxic to humans and what exposure point is non-toxic. GRAS and the Hunter Commission, as well as studies from other nations, expand this list. Accordingly, in considering what solvent additive should be placed into the cigarette, toxicologic data for candidate compounds are reviewed. Compounds with published, specific TWA's are immediately applicable for human exposure so long as that exposure is at or below stated limits. Since this invention includes many alcohols without stated limits, the additional alcohols would then become available for inclusion in commercially-available cigarettes only after further toxicological studies on them are completed.

Further, the alcohols selected and sprayed on the tobacco preferably must have physical properties such that the cigarette can be machined at current cigarette production rates and the alcohol still remains stable in the cigarette until it is smoked. For instance, the blocking alcohol preferably should have a vapor pressure low enough to avoid excessive evaporation over the course of the cigarette's shelf life, should not cause moisture spotting or wetting of the tobacco at loads sufficient to transfer and block in the lung, and should not change in chemistry during the pyrolysis of the tobacco.

Importantly, the TLV for the alcohol must be sufficient to effect the desired blocking action. Fortunately, much is now understood about the metabolic pathway of this family of carcinogens and clear guidance is provided by the literature in consideration of a compound's potential effectiveness. For instance, it is known that chemical compounds must be first metabolized into a DNA-binding intermediate. This metabolism is mediated by enzymatic action. While there may be any number of enzymes, there are a finite number of molecules of TSNA available for metabolism. Accordingly, on the basis of an equal molar theory, an effective compound should be measurable in the inhaled smoke stream on a 1:1 molecular basis. Discussion herein of an equal molar theory should, however, not limit the scope of this invention as it is possible, but not now known, that a fraction of the solvent may entirely block the nitrosamines.

SAMPLE CALCULATIONS

Cyclohexanol appears to meet these criteria. OSHA considers eight continuous hours in an atmosphere containing two hundred milligrams of cyclohexanol per cubic meter of air to be safe. Approximately ten percent, in a range of five to twenty percent, of the initial load on the tobacco is transferred into the volume of smoke inhaled by the smoker in the course of smoking one cigarette.

Surprisingly, under an equal molar matching theory, this level of cyclohexanol is many times higher than the minimum amount of blocker required to match the total molecular concentration of inhaled nitrosamines, as follows:

Concentration of tobacco specific nitrosamines delivered by a fully smoked filtered cigarette is given in the range of 140 nanograms to 830 nanograms with specific ranges shown in Table III (Hoffman, D., LaVoie, E. J., and Hecht, S. S., *Cancer Letters*, 26 (1985) 67-75.)

TABLE III

Nitrosamines delivered in cigarette smoke from filtered cigarettes:

| | Average Molecular Weight | Concentration Range (Nanograms per Cigarette) |
|---|---|---|
| NNN | 177 | 50-310 |
| NNK | 207 | 30-150 |
| NATB + NABS* | 190 | 60-370 |

NNN - N-nitrosonornicone
NNK - (methylnitrosaino)-1-(3-pyridyl)-1-butanone
NATB - N-nitrosoanatabine
NABS - N-nitrosanabasine For the highest concentrations of nitrosamines given in Table III, the amount of blocker required to match the molecular concentrations at these upper limits are calculated and given in Table IV below.

It can be seen that when the highest level of all the nitrosamines are to be blocked by cyclohexanol, the blocker concentration at the TWA value of OSHA provides one hundred and forty-two times more material than required in molecular matching of cyclohexanol with all nitrosamine molecules present.

TABLE IV

Blocking of Nitrosamines in Cigarette Smoke (Nanograms of Cyclohexanol per Cigarette)

| Nitrosamine | Blocker Required** | Blocker Delivered* to Blocker Required |
|---|---|---|
| NNN | 175 ng | 360:1 |
| NNK | 73 ng | 863:1 |
| NATB + NABS | 195 ng | 323:1 |
| NNN + NNK + | 248 ng | 254:1 |
| NNN + NNK + NATB + | 443 ng | 142:1 |

TABLE IV-continued

| Blocking of Nitrosamines in Cigarette Smoke (Nanograms of Cyclohexanol per Cigarette) | | |
|---|---|---|
| Nitrosamine | Blocker Required** | Blocker Delivered* to Blocker Required |
| NABS | | |

*Cyclohexanol concentration in cigarette smoke at TWA limit of OSHA, i.e. 200 mg/m$^3$ or 63 micrograms/cigarette.
**Assuming equal molar matching.

Although menthol does not have the same nitrosamine blocking effect as alcohols of this invention, the known method of applying menthol to tobacco is relevant herein because of the established transfer efficiency and shell stability of menthol in the cigarette. Accordingly, menthol's melting point, boiling point, vapor pressure and molecular weight are relevant criteria for the selection of the preferred blocking alcohols to be used. Thus, the preferred alcohols either have no toxicity or low toxicity, can be applied directly onto the tobacco and then heat-released as the tobacco is burned, are comparable to menthol in molecular characteristics so as to be stable in the cigarette rod and efficiently transferred into the smoke, are comparable to NNN in molecular weight so that the amount thereof applied to the tobacco will not wet it excessively, preferably have a pleasant taste and odor, and of course have the desired blocking effect.

Although any of the (blocking) alcohols mentioned elsewhere in this disclosure can be used in the direct spray method of this invention, preferred alcohols appear to be: monohydric alcohols: n-octyl alcohol and capryl alcohol; polyhydric alcohols: 1,3-butanediol, pinacol and 1,2,4-butanetriol; compounds with resonant hydroxyl species: n-decyl alcohol, lauryl alcohol, cetyl alcohol, stearyl alcohol and cinnamyl alcohol; and alternative alcohols: 2-ethyl butyl alcohol, ethyl hexanol, n-nonyl alcohol, and methyl cyclohexanol. Cetyl alcohol and stearyl alcohol though of relatively large molecular size are non-toxic and thus are included herein. The properties and characteristics of these alcohols are set forth below in Table V.

TABLE V

| Alcohol | Formula |
|---|---|
| 1. n-Octyl alcohol | $CH_3(CH_2)_5CH(OH)CH_5$ |
| 2. Capryl alcohol | $CH_3(CH_2)_5CHOHCH_5$ |
| 3. 1,3 Butanediol | $CH_3CHOHCH_2CH_2OH$ |
| 4. Pinacol | $(CH_3)_2COHCH(CH_3)_2$ |
| 5. 1,2,4-Butanetriol | $HOCH_2CHOHCH_2CH_2OH$ |
| 6. n-Decyl alcohol | $CH_3CH_2CH_2CHOH(CH_2)_5CH_3$ |
| 7. Lauryl alcohol | $CH_3(CH_2)_{11}OH$ |
| 8. Cetyl alcohol | $CH_3(CH_2)_{15}OH$ |
| 9. Stearyl alcohol | $CH_3(CH_2)_{17}OH$ |
| 10. Cinnamyl alcohol | $C_6H_5CH{:}CHCH_2OH$ |
| 11. 2-Ethyl butyl alcohol | $C_2H_5CH(C_2H_5)CH_2OH$ |
| 12. Ethyl hexanol | $CH_3(CH_2)_3CH(C_2H_3)CH_2OH$ |
| 13. n-Nonyl alcohol | $CH_3(CH_2)_7CH_2OH$ |
| 14. Methyl cyclohexanol | $CH_3C_6H_{10}OH$ |
| 15. Cyclohexanol | $C_6H_{12}O$ |
| 16. Dipropylene glycol monomethyl | $CH_3OC_3H_6OC_3H_6OH$ |
| 17. Methol | $C_{10}H_{20}O$ |

TABLE V

| Alcohol | Toxicity | Molecular Weight | Density (g/cm$^3$) | Melting Point (°C.) | Boiling Point (°C.) | Solubility* Vapor Pressure (mmHg) | Water | Ethyl Alcohol | Ether |
|---|---|---|---|---|---|---|---|---|---|
| 1. | Flavor agent | 130 | 0.82 | −15 | 86 | 1(54° C.) | | s | s |
| 2. | Low toxity, aromatic | 130 | 0.83 | −30 | 178 | 1(32.8° C.) | | # | # |
| 3. | Non-toxic | 90 | 1.01 | <−50 | 207 | .06(20° C.) | s | s | i |
| 4. | Low-toxicity | 118 | 1.05 | 43 | 174 | 1(44° C.) | | v | v |
| 5. | Non-toxic | 106 | 1.02 | N/A | 172 | N/A | # | # | # |
| 6. | Low-toxicity | 158 | 0.83 | −12 | 210 | 1(69.5° C.) | i | s | s |
| 7. | Low-toxicity | 186 | 0.83 | 26 | 255 | 1(91° C.) | i | s | s |
| 8. | Non-toxic | 243 | 0.82 | 50 | 344 | 1(122.7° C.) | i | | v |
| 9. | Non-toxic | 271 | 0.81 | 59 | 210 | 1(50° C.) | i | s | s |
| 10. | | 134 | 1.04 | 34 | 257.5 | 1(72.6° C.) | | v | v |
| 11. | Low-toxicity | 102 | 0.83 | <−15 | 149 | 0.9(20° C.) | | # | # |
| 12. | Low-toxicity | 130 | 0.83 | <−76 | 185 | 1(54° C.) | i | # | # |
| 13. | Low-toxicity | 144 | 0.83 | | 215 | 1(59.5° C.) | i | # | # |
| 14. | 50 ppm (235 mg/m$^3$)* | 114 | 0.92 | | 173 | 1.5(30° C.) | | | |
| 15. | 50 ppm (200 mg/m$^3$)* | 100 | 0.96 | 25 | 161 | 1(21° C.) | s | s | s |
| 16. | 100 ppm (600 mg/m$^3$)* | 132 | 0.95 | −80 | 189 | .3(20° C.) | | | |
| 17. | Flavor Agent | 156 | 0.90 | 44 | 216 | 1(56° C.) | | v | v |

*TWO OSHA: weighted average for a normal eight hour work day and forty hour work week, unless otherwise indicated (adopted by OSHA).
*Key
i = insoluble
= slightly soluble
s = soluble
v = very soluble
# = soluble in all proportions The manufacture of cigarettes today typically involves the following eighteen process steps: (1) leaf purchase; (2) conditioning before stemming; (3) stemming; (4) redrying; (5) prizing; (6) aging; (7) ordering; (8) blending; (9) ordering; (10) casing; (11) cutting; (12) drying; (13) cooling; (14) top dressing; (15) bulking; (16) making; (17) packaging; and (18) storing the finished goods. A known variation of this process reverses steps (14) and (15) so that bulking is done before the top dressing is applied. Also, various methods of manufacturing cigarettes and cigarette constructions, smoke formation and smoke compositions are discussed in greater detail in Max Samfield, *Research and Manufacturing in the U.S. Cigarette Industry* (1980). At step (16) ("making") the cut or rag tobacco is machined into a final cigarette. In modern cigarette plants, a rapid conveyor system is used to continuously supply cut tobacco to the highly mechanized making line. After the tobacco has been conditioned, steamed, prized, blended, cured, dressed and bulked, the manufacturer forms the cigarette, adds the filter and feeds the finished product to the packing machine. A process for machining tobacco into cigarettes and applying a filter thereto is found in U.S. Pat. No. 3,854,487.

The blocking alcohol or compound of this invention is preferably added to the cut tobacco after the final drying which is step (12), and when in the cooler of step (13). The coolers are typically of the rotary type and have a stationary nozzle inside their cylinders. Compounds added to the rag tobacco during the cooling step (13) are generally referred to as top flavorings or top dressings. Discussions of flavoring materials and casings, processes therefor, and effects thereof are found in "The Casing and Flavouring of Cigarettes," Max Samfield, *Tobacco Journal International*, 5/1984 Oct. The compound is sprayed on the rag tobacco as it tumbles in the cooler cylinder. Flavorings, as are the subject alcohols or compounds, are added or sprayed after final drying to minimize the loss thereof, and preferably are applied immediately before entering the making machine. The tobacco is preferably redried before the top dressing is applied since the top dressings do not age well and evaporate easily. This, therefore, is standard industry practice for cigarette manufacture, and the process of this invention to add the blocking compound to the cut tobacco can be done utilizing current production machinery with only minor modifications thereto and for makers running at 3,200 to 8,000 cigarettes per minute. The blocking alcohol can either be sprayed through the same nozzle as the flavorings or through a different nozzle, and sprayed on the cut tobacco either with, before or after the other dressings.

A carrier solution for the blocking alcohol may be required to assure an even and sufficient loading of the alcohol on the mass of tobacco. In other words, the quantity of the chosen alcohol, such as cyclohexanol, to load a given quantity of tobacco may not provide sufficient solution to even wet the tobacco thereby necessitating the use of a carrier solution for the alcohol. Most of the blocking alcohols herein are soluble in ethyl alcohol, which is a preferred solvent for cyclohexanol (and methylcyclohexanol) as it dissolves cyclohexanol easily and evaporates rapidly from the tobacco at the completion of the loading step. Ethyl alcohol is a solvent for alcohols specifically named herein and is also widely used as the solvent for top flavorings or dressings. The minimum concentration of cyclohexanol in an ethyl solution is that required to solubilize the cyclohexanol, and the maximum concentration is that required to evenly distribute the cyclohexanol in the cooling drum. This upper limit varies according to the size and/or speed of the cooling unit, and the amount of tobacco in the cooler. Water is an alternative solvent, but its utility is limited though since it elevates the moisture content of the tobacco, and the moisture content of a cigarette should generally be below twelve and a half percent of weight. Additionally, the solubility of alcohols in water is limited in most cases.

As previously discussed, one or more vitamins, such as Vitamins A, B, C and E, can also be added to the alcohol solution. Vitamin A in particular is believed to inhibit cancers. Further disclosures for the use of Vitamin A in cigarettes are those of U.S. Pat. No. 3,339,558 and Japanese No. 55-79,319 (Sharman, Jun. 14, 1980).

EXAMPLE 6

Cigarettes were hand-laced with cyclohexanol, that is by evenly injecting the alcohol into the rod of a manufactured cigarette using a machine-controlled syringe. To detect initial transfers, 8750 micrograms of cyclohexanol were loaded on the tobacco of a single cigarette. Sixty cigarettes were smoked on a standard smoking machine using Cambridge filter pads to collect the particulate phase, where most of the material is carried. A transfer efficiency of ten percent was established with this test cigarette. This resulted in a smoked concentration of 2778 milligrams of cyclohexanol per cubic meter, or 1389% of TLV. The GC was then calibrated and a production of cigarettes run. The load was 620 micrograms per cigarette, and the transfer efficiency was ten percent. The smoked concentration was 197 milligrams per cubic meter, which is 99% of cyclohexanol TLV and therefore considered safe. This new machined cigarette delivered a safe concentration of cyclohexanol, and the delivery exceeded the total concentrations of TSNA's in the cigarette by a factor of one hundred and thirty-two.

Additionally, cigarettes of this invention wherein a blocking alcohol (cyclohexanol) was sprayed onto the tobacco were successfully produced at production speeds of 3,200 cigarettes per minute without any making equipment modifications and without any unusual resulting cigarette spoilage.

This cigarette has shelf life characteristics indistinguishable from customary cigarettes, and exhibits no increased tendency to spot or deform. Foremost though, this cigarette selectively reduces the smoker's exposure to the effects of the most abundant carcinogen in cigarette smoke at the smoker's lung, which is the critical organ associated with smoking disease.

The subject cigarette construction thereby provides for the effective passive release of the blocking alcohol into the tobacco smoke stream aerosol and then into the smoker's respiratory system. While the blocking alcohol thereby manufactured in the cigarette when inhaled in the cigarette's tobacco smoke stream fortifies the smoker's lung's resistance to a family of well known carcinogens, it does not impact on the cigarette's taste, blend, mouthfeel, draw or burn. It may though give a slight aroma to the cigarette package. It further appears that the blocking alcohol does not interact with any particular cigarette blend type.

Additionally, there is no need to limit the present invention to alcohols which exist in the liquid state at ambient temperature. Alcohols which exist in the solid state at ambient temperature also fall within the scope of the present invention. While it is unimportant whether the alcohol(s) is administered as a solid or a liquid, it is important that the alcohol(s) be administered in such a manner that the four aforementioned objectives are satisfied.

Most alcohols tend to fight the shell wall membranes that surround them, and over time, the encapsulated alcohol material migrates (or leaches) through the shell wall and into either the filter section, the paper or the rag, according to where it was originally placed. Further, the shell life of microcapsules containing alcohol is relatively poor, and microcapsules do not survive handling well. Thus spraying is the preferred technique for incorporating the alcohol in the cigarette. The present invention is an extension of the technology disclosed in International Application No. PCT/US No. 88/00204 of C. A. Blockers, Inc., of Louisville, Ky., entitled "Process for Manufacturing Cigarettes," which discloses spraying techniques.

The flavorants and blocking alcohols are combined into a unique solution which is sprayed through the nozzle. Tobacco flavorings are discussed for example in Leffingwell, et al., "Tobacco Flavoring for Smoking Products, R. J. Reynolds Tobacco Co., 1972, pages 16–19. The amount of blocking compound contained in this solution is rigorously controlled to insure that the amount on the tobacco rod is, when transferred into the smoke stream, below the established TLV for that compound. The combination of the blocking alcohol and the flavorant is called a "flavoring system" and this flavoring system varies according to the manufacturer's desired smoking taste and aroma characteristics. Carrier mediums are not required. Cyclohexanol and/or t-butanol, for example, can be sprayed directly on the tobacco without being placed in solution. The concentrations of flavorants used are a function of the targeted aroma or taste characteristic. Examples of coolers, spray nozzles and the like useful in making cigarettes are found in U.S. Pat. Nos. 687,308, 4,590,954, 4,744,375, 4,757,830, 4,762,137, 4,730,627 and 4,619,276. After the tobacco exits the cooler, it is desirable to place it into a moisture resistant container before it is placed into the tobacco making machine.

Mediums described in U.S. Pat. No. 4,449,541 are common carrier mediums today and are preferred because they do evaporate off the tobacco after delivering to the tobacco flavorants that manufacturers want dispersed evenly over a large surface area. Tobacco water, however, cannot exceed 12.5 percent of weight before the tobacco becomes damp.

Materials that are part of the cigarette blend (which includes the top dressings) are, collectively, known as the "fuel" for the combustion process. Top dressings generally neither increase nor decrease the temperature of the smoke stream. Cyclohexanol and t-butanol, for example, also do not cool the smoke stream.

The blocking alcohol can also be placed in the cigarette filter with the same transfer into the smoke stream control and with the same blocking efficacy in mammals. Methods of incorporating the blocking compound into the cigarette filter correspond to methods used to enclose menthol in filters. See, e.g., U.S. Pat. Nos. 3,635,226, 4,715,390, 4,729,391 and 4,687,008.

The key preferred alcohol is cyclohexanol because it has exhausted published toxicology, is highly effective in the laboratory, and has little impact on smoker flavored characteristics. The same is true for (3-)methylcyclohexanol and 1-hexanol. Although 2-octanol is a very powerful flavorant, it adds an enormous taste aroma burden to the cigarette. Minimum acceptable amounts to be placed in the cigarette rod for acceptable smoking characteristics are determined by the following criteria: (1) efficacy in acute animal testing; (2) acceptable characteristics to the smoker when combined with an ordinary tobacco blend; and (3) exposure values at or below threshold limit values (TLV's) established for human exposure.

A current theory as to the mechanism(s) of nitrosomine metabolism are that they are activated through hydroxylization and that the electrophilic intermediate selectively and preferentially biased with the blocking alcohol. The blocking alcohol then acts as a scavenger collecting the electrophilic intermediate before it is further metabolized into a bounding carcinogen. The scavenged electrophilic intermediate combined with the alcohol is then passed through the body through the normal renal, hemphatic or respiratory systems as a nontoxic, inert compound.

Table VI below lists the compounds tested for their effect on the localization of radioactivity in bronchial epithelium one hour after intravenous administration of [$^{14}$C]NNN. Unless indicated otherwise, the compounds were parenterally administered acutely at various times prior to [$^{14}$C]NNN. In many cases only one mouse was studied for each compound. By visually inspecting the autoradiographs, it was determined whether the compound had (1) no apparent effect on the uptake in the bronchial epithelium compared to a mouse receiving only [$^{14}$C]NNN, (2) only a minimal decrease in radioactivity in the bronchial epithelium or (3) a significant decrease in radioactivity in the bronchial epithelium.

It is apparent from Table VI that most compounds have no effect on the localization of radioactivity in the bronchial epithelium after administration of NNN, and that some alcohols also have no or minimal effect. Also, most but not all of the compounds which have a significant effect are alcohols. The approximately twelve compounds that are not alcohols but that have either a minimal or significant effect are of particular interest, as they provide further clues to the mechanism. Some of these are well-known inhibitors of either P-450, aldehyde dehydrogenase or alcohol dehydrogenase. These are the enzymes which apparently activate NNN. The other non-alcohols apparently are either metabolized to alcohols, have a resonance species which is an alcohol, and/or are inhibitors of aldehyde or alcohol dehydrogenase.

TABLE VI

Effect of substances on the localization of radioactivity in bronchial epithelium of mice one hour after intravenously receiving [$^{14}$C] nitrosonornicotine.

| Compound Tested | No Decrease | Minimal Decrease | Significant Decrease |
|---|---|---|---|
| metyrapone | | | X |
| nicotine | X | | |
| retinoic acid | | X | |
| peanut oil | X | | |
| nicotine (4 days + acute) | X | | |
| nicotine (18 weeks) | X | | |
| methotrexate | X | | |
| cycloleucine | X | | |
| methionine | X | | |
| 6-aminonicotinamide | X | | |
| ascorbic acid | X | | |
| nicotinamide | X | | |
| pregnenolone-16a-carbonitrile (chronic) | X | | |
| tween/$H_2O$ | X | | |
| selenium selenite | X | | |
| butylated hydroxyanisole | X | | |
| vitamin E | X | | |
| olive oil | X | | |
| disulfiram | X | | |
| 1% carboxymethylcellulose | X | | |
| pilocarpine | X | | |
| cobaltous chloride | X | | |
| sinefungin | X | | |
| nicotine (1 year) | X | | |
| DMS0 - ip (less decrease if given orally) | | X | |
| n-butanol | | X | |
| carrot juice | X | | |
| pyrazole | | X | |
| phenobarbital | X | | |

-continued

| Compound Tested | No Decrease | Minimal Decrease | Significant Decrease |
|---|---|---|---|
| t-butanol | | | X |
| indole-3-carbinol | X | | |
| ethanol | | | X |
| carrot puree - chronic | X | | |
| broccoli puree - chronic | X | | |
| diethyldithiocarbamate | | | X |
| benzyl isothiocyanate | | | X |
| coumarin | X | | |
| acetate solution | X | | |
| propionate solution | X | | |
| n-butyrate solution | X | | |
| a-amino-n-butyric acid | X | | |
| isobutyrate solution | X | | |
| valerate solution | X | | |
| isovalerate solution | X | | |
| succinate solution | X | | |
| WR 2721 | X | | |
| dimercaptosuccini acid | X | | |
| WR 1065 | X | | |
| diaminopropane HCl | | X | |
| putrescine | | X | |
| mucomyst | X | | |
| parqyline | | X | |
| tryptamine HCl | X | | |
| L-trypotophan | X | | |
| difluoromethylornithine | | X | |
| piperonal | | | X |
| isoamyl alcohol | | | X |
| isobutyl alcohol | | | X |
| phenobarbital (chronic) | X | | |
| ethanol as white wine | | X | |
| ethanol as bourbon | | X | |
| 1-menthol | X | | |
| propyl alcohol | | X | |
| isopropyl alcohol | | X | |
| ethanol as red wine | | X | |
| 5KF 525A | X | | |
| active amyl alcohol | | | X |
| imidazole | | | X |
| 2-pentanol | | | X |
| sec-butyl alcohol | | | X |
| retinol | | X | |
| t-butanol vapors | | | X |
| 1-menthol vapors | | X | |
| iso-amyl vapors | | | X |
| cyclohexanol vapors | | | X |
| hexyl alcohol vapors | | | X |
| B-estradiol | X | | |
| progesterone | X | | |
| testosterone | X | | |
| 2-methylnaphthalene | X | | |
| naphthalene | | | X |
| corn oil | X | | |
| 2-pentanol vapors | | | X |
| active amyl alcohol vapors | | | X |
| propylene glycol | X | | |
| glycerol | X | | |
| hydroquinone | X | | |
| decyl alcohol vapors | X | | |
| 1-heptanol vapors | | X | |
| 1-nonanol vapors | X | | |
| 1-octanol vapors | X | | |
| 2-octanol vapors | | | X |

Details of the alcohol experiments which have been described previously in the Waddell, et al., *Science* article or elsewhere in this disclosure, namely t-butanol, n-butanol, ethanol and cyclohexanol, are not repeated herebelow.

Orally administered alcohols found to cause a significant decrease in the localization of radioactivity in bronchial epithelium of mice following the intravenous administration of [$^{14}$C] nitrosonornicotine ([$^{14}$C]NNN) are isoamyl alcohol, isobutyl alcohol, active amyl alcohol, 2-pentanol and sec-butyl alcohol. For each of these alcohols, the mouse was fasted overnight, the alcohol in aqueous solution at a dose of 1.0 g/kg was administered by gavage and after twenty minutes the [$^{14}$C]NNN was injected intravenously. All mice were sacrificed one hour after the [$^{14}$C]NNN treatment and processed for whole-body autoradiography, as described previously.

Additional alcohols were tested for their effects on the localization of radioactivity of [$^{14}$C]NNN in bronchial epithelium when the alcohols were administered by inhalation. For these studies, two ml of the alcohol were placed in the bottom of a 600 ml glass beaker. A wire mesh platform was constructed so that the mouse was positioned approximately three-quarter to one inch above the alcohol. The beaker was kept tightly sealed unless otherwise indicated. All mice were fasted overnight, except where noted, and sacrificed one hour after intravenous [$^{14}$C]NNN administration. These mice were also processed for whole-body autoradiography. Although the protocols varied slightly as summarized below, these minor differences should not effect the results. The alcohols as mentioned in Table VII below were found to be effective in these inhalation studies:

TABLE VII

A. Exposures in beakers maintained at 50° C. (plus or minus 2° C.) in a water bath:

| Compound | Pretreatment | Post-NNN Treatment |
|---|---|---|
| t-butanol | 5 min at 50° C. | Clean beaker (no alcohol), 1 hr room temperature |
| isoamyl alcohol | 5 min at 50° C. | 5 min at 50° C., 55 min in same beaker opened to fresh air |
| 1-hexanol | 5 min at 50° C. | 10 min at 50° C.; 50 min in same beaker opened at fresh air |

B. Exposure in beakers at room temperature. Beakers were equilibrated with alcohol ten minutes before adding the mouse.

| Compound | Pretreatment | Post-NNN Treatment |
|---|---|---|
| 2-pentanol | 5 min | Clean beaker (no alcohol), 1 hr room temperature |
| active amyl alcohol | 5 min | Clean beaker (no alcohol), 1 hr room temperature |

C. Beakers equilibrated with alcohols at least 20 min in 54° C. (plus or minus 2° C.) oven. Mice injected with [$^{14}$C]NNN before exposing to alcohols. All exposures at room temperature. Mice were not fasted.

| Compound | Post-NNN Treatment |
|---|---|
| 2-octanol | 5 min exposure to alcohol; 55 min in clean beaker |
| 1-hexanol | 5 min exposure to alcohol; 55 min in clean beaker |
| 3-methylcyclohexanol | 5 min exposure to alcohol; 55 min in clean beaker |

All of the alcohols listed were from the data in Table VI above, except for 3-methylcyclohexanol, which is even more potent than cyclohexanol.

For all the remaining compounds the general protocol was to administer the potential blocker some minutes prior to administration of the [$^{14}$C]NNN. Potential blockers were given orally, intraperitoneally or by inhalation, and the [$^{14}$C]NNN was given intravenously.

The 2-octanol, 1-hexanol and 3-methylcyclohexanol are perhaps the most appropriate of these inhibitors. These three alcohols are among the most potent inhibitors in our experiments in mice. They have boiling points of 180°, 158° and 174°, respectively, which makes them sufficiently non-volatile to consider using directly. Furthermore, 2-octanol and 1-hexanol are approved by the FDA as additives.

Five of the substances which caused a significant decrease in the localization of radioactivity in bronchial epithelium of mice one hour after receiving intravenous [$^{14}$C]NNN are solids at ambient temperature. These are metyrapone, diethyldithiocarbamate, piperonal, imidazole and napthalene. Also, the following substances, which exerted a minimal response on the uptake of radioactivity in the bronchial epithelium, are solids: retinoic acid, pyrazole, diaminopropane HCl, putrescine, parglyine, difluoromethylornithine, retinol and 1-menthol.

EXAMPLE 7

This work was performed to determine the amount of cyclohexanol transferred to smoke from cigarettes loaded with the chemical. Duplicate runs were carried out. In each run, smoke from twenty cigarettes, twelve puffs/cigarette, was collected. Cyclohexanol was analyzed in both the particulate (filter extract) and non-particulate phases of cigarette smoke by gas chromatography. A standard curve was made and analyzed simultaneously with the samples. Each analysis was duplicated, and the results of these analyses are summarized below.

Transfer of Cyclohexanol to Cigarette Smoke

| | | Amount Recovered in Smoke (ug/cigarette) | | | % Transfer | | |
|---|---|---|---|---|---|---|---|
| | Amount loaded ug/cig. | Particulate | Non-particulate | Total | Non-Particulate | Total particulate | Transfer |
| Cyclo-hexanol | 713.7 | 16.7 | 30.8 | 47.5 | 2.3 | 4.3 | 6.6 |

Total Concentration of Cyclohexanol in Smoke

The total volume of smoke from 20 cigarettes $=12\times33.3\times20=7992$ ml

Concentration of Cyclohexanol = 950 ug/7992
= 118.9 ug/liter

Summary

| | Concentration in Smoke | TLV | % of TLV |
|---|---|---|---|
| Cyclohexanol | 118.9 | 200 | 59.5 |

Calculation of the Amounts of Cyclohexanol Loaded/Cigarette:

These calculations are based on the following information:

1. the concentration of cyclohexanol in the flavoring was made to give 366 g of cyclohexanol/15 lbs of flavoring; and
2. a total of 1.5 lbs of the cyclohexanol containing flavoring was mixed with 100 lbs of tobacco and used to make 51,282 cigarettes. 1.5 lbs of flavoring contains 36.6 g cyclohexanol.

$$\text{Loading of cyclohexanol/cigarette} = \frac{36.6\times10^6}{51{,}282} = 713.7 \text{ ug}$$

Cigarette Tobacco Flavoring System

A flavoring system of the present invention is a combination of two flavoring ingredients, a carrier medium and cyclohexanol. The breakdown of the top dressing system is as follows:

| | |
|---|---|
| Artificial deer tongue | 0.10% |
| Apple tobacco flavor | 0.10 |
| Cyclohexanol | 0.81 |
| 5D Alcohol #4 | 98.99 |
| | 100.00% |

(SD alcohol #4, which is approved for use in the tobacco industry, is ethyl alcohol denatured with nicotine and methylene blue.)

This top dressing is applied to the tobacco in the following ratio:

| Top Dressing:Rag Tobacco |
|---|
| 15 pounds:1000 pounds |

Using conventional manufacturing practices, 1,000 pounds of dressed rag tobacco yields 510,000 finished cigarettes. These ratios and yields are to be strictly monitored. The ratio of top dressing to rag tobacco is based on the published TLV's for the active ingredient of this dressing—cyclohexanol. The published TLV for cyclohexanol is 200 micrograms per liter. This top dressing yields 366 grams of cyclohexanol per thousand pounds of tobacco, or 714 micrograms per cigarette. Transfer efficiency data indicates that 6.6 percent of the initial load is recovered in smoking of the cigarette (12 puffs of 33.3 cm$^3$ per puff).

Application of this dressing in accordance with these guidelines yields the following concentrations of cyclohexanol in the inhalated smokestream for a fully smoked cigarette:

| | ug/Liter |
|---|---|
| Fully Smoked Cigarette | |
| Cyclohexanol concentration in smoke | 118.9 |
| TLV | 200.0 |
| Percent of TLV | 59.5% |
| Instant ("Puff") Exposure | |
| Cyclohexanol concentration in smoke | 9.9 |
| TLV | 200.0 |
| Percent TLV | 4.9% |

| Daily Body Burden | Exposure vs. Effect Level In Animals |
|---|---|
| 1 Pack of Cigarettes | 1:40,000 |

As reported in the International Agency for Research on Cancer (IARC), 1986 report, *Tobacco: A Major International Health Hazard*, NNN and NNK are present in the smoke stream at concentrations of 0.32–4.14 ug per cigarette depending on filtration (NNN=0.2–3.7 ug; NNK=0.12–0.44 ug). In accordance to the application guidelines for this dressing, the cyclohexanol blocking compound is present in the smokestream at an equal molar ratio up to 863:1 (cyclohexanol to NNN).

Calculations Related to Cyclohexanol Exposure (1) Air concentrations from cigarette smoke From a cigarette with 0.500 mg of cyclohexanol, 0.050 mg (10%) is transferred to the smoke. Therefore, 0.050 would be in 315 ml, which would be expected from nine puffs at 35 ml per puff. This is equivalent to 0.050 ml/315 ml, or 0.159/mg liter or 159 mg per cubic meter. This means that the instantaneous concentration of cyclohexanol to a smoker is about 75% of the TLV value. However, this exposure in contrast to the eight-hour work day assumption of the TLV is only during the actual puffing time for the smoker. The TLV documentation (1943) reports slight degenerative changes in rabbits at about 600 mg per cubic meter.

(2) Daily body burden

If one assumes that all the cyclohexanol in the smoke is absorbed by the smoker, a very conservative assumption, then the body burden from a pack of cigarettes would be 1.0 mg based on the finding that 0.050 mg of cyclohexanol is available from each cigarette, and there are twenty cigarettes in a pack. This results in a daily burden of 0.014 mg/kg of cyclohexanol exposure per day for a one pack a day smoker.

For comparison purposes, the acute intravenous toxic dose for mice is 270 mg/kg, or a dose 20,000 times higher than the human exposure for a one pack a day smoker. If one looks at the doses in rats that cause pharmacological changes (enzyme or neurotoxicity), one gets a similar 20,000 fold difference in exposure versus effect level in animals. This assumes that all the cyclohexanol is absorbed, which it certainly is not, so the safety factor for any kind of response is even higher, possibly 1:100,000.

Table VIII below sets forth formulas for two top dressings of the present invention which use both cyclohexanol and 2-octanol. Cyclohexanol is effective against NNN and 2-octanol against NNK. These formulations have acceptable taste and flavor characteristics.

TABLE VIII

| | By volume | |
|---|---|---|
| | '69 | '70 |
| Cyclohexanol | 5.39% | 5.34% |
| 2-Octanol | .54 | .54 |
| Herbal maskant .837386 | .05 | .10 |
| Herbal maskant .837383 | .05 | .10 |
| Deer tongue | .10 | .10 |
| Apple | .15 | .15 |
| Artificial maple | .10 | .10 |
| SD-A4 | 56.12 | 56.02 |
| Water | 37.50 | 37.50 |
| | 100.00% | 100.00% |

Application instructions: 1.5 lbs. of formula to 100 lbs. of tobacco.

Another embodiment of the present invention is to incorporate these alcohols in a face mask (not shown) so that the vapors thereof are released and inhaled by the wearer of the mask. This mask can be worn in polluted industrial environments or in environments where nitrosamines are present in the air.

A mouth spray device can be used to administer the alcohols by inhalation at will prior to exposure to any nitrosamines in the environment, and particularly those in the tobacco smoke stream. Hence, another embodiment contemplates a mouth spray or mist device (not shown) having a cylindrical body of plastic or metal which contains one or more alcohols of the present invention. A non-toxic carrier gas or propellant gas, such as compressed air or nitrogen, can also be used. A tobacco smoke stream aerosol containing the alcohol(s) is thereby defined. When the alcohols of the present invention are administered by inhalation, a concentration of the alcohol in air of only about 0.001% is sufficient for purposes of delocalization nitrosamines in the respiratory epithelium. See also U.S. Pat. Nos. 4,016,279, 4,232,002 and 4,243,543.

From the foregoing detailed description, it will be evident that there are a number of changes, adaptations and modifications of the present invention which come within the province of those persons skilled in the art. However, it is intended that all such variations not departing from the spirit of the invention be considered as within the scope thereof as limited solely by the claims appended hereto.

What is claimed is:

1. A tobacco smoking article comprising:

smoking tobacco;

a container in which said smoking tobacco is contained; and a compound supported by said container, said compound being associated with said smoking tobacco such that when said smoking tobacco is smoked the vapor of said compound is inhaled by the smoker in the tobacco smoke stream, and said compound being present in an amount sufficient to inhibit the selective localization of nitrosamines and metabolities thereof in the tissues of the smoker of said smoking tobacco but not to produce any toxic side effects in the smoker who is inhaling the vapor thereof in the tobacco smoke stream;

wherein said compound is sprayed onto said smoking tobacco before said smoking tobacco is placed in said container.

2. The tobacco smoking article of claim 1 wherein said container comprises cigarette paper in an elongated configuration and containing said smoking tobacco therein to form a tobacco rod having a rod end, and a cellulose acetate tow filter secured to said rod end.

3. The tobacco smoking article of claim 1 wherein said tissues include bronchial epithelium tissue.

4. The tobacco smoking article of claim 1 wherein said compound is an alcohol.

5. The tobacco smoking article of claim 4 wherein said alcohol comprises a cyclohexanol.

6. The tobacco smoking article of claim 4 wherein said alcohol comprises 3-methylcyclohexanol or 1-hexanol.

7. The tobacco smoking article of claim 4 wherein said alcohol comprises 2-octanol.

8. The tobacco smoking article of claim 1 wherein said compound comprises an alcohol which is sprayed in an ethyl alcohol solution onto said smoking tobacco.

9. The tobacco smoking article of claim 1 wherein said compound is selected from the group of metyrapone, DMSO—ip, n-butanol, t-butanol, ethanol, diethyldithiocarbamate, benzyl isothiocyanate, piperonal, isoamyl alcohol, isobutyl alcohol, active amyl alcohol, imidazole, 2-pentanol, sec-butyl alcohol, t-butanol, isoamyl, cyclohexanol, hexyl alcohol, naphthalene, 2-pentanol, active amyl alcohol, 2-octanol and 3-methylcyclohexanol.

10. A process for manufacturing cigarettes comprising the steps of:

spraying redried cut rag tobacco with at least one compound which is capable when the vapor thereof is inhaled by the smoker of inhibiting the selective localization of at least one nitrosamine or metabolite thereof in the tissues of the smoker and in an amount sufficient to inhibit the selective localization but not to produce any toxic effects in the smoker; and machining the sprayed, redried cut rag tobacco into a cigarette.

11. The process for manufacturing cigarettes of claim 10 wherein said compound comprises an alcohol and said spraying includes spraying said alcohol in a solution on the redried cut rag tobacco.

12. The process for manufacturing cigarettes of claim 11 wherein said solution includes flavorant and a carrier medium.

13. The process for manufacturing cigarettes of claim 11 wherein said spraying includes spraying said solution in an amount of generally 1.5 pounds of said solution for each 100 pounds of said redried cut rag tobacco.

14. The process for manufacturing cigarettes of claim 10 wherein said compound includes cyclohexanol and 2-octanol.

15. The process for manufacturing cigarettes of claim 10 wherein said compound is selected from the group of metyrapone, DMSO—ip, n-butanol, t-butanol, ethanol, diethyldithiocarbamate, benzyl isothiocyanate, piperonal, isoamyl alcohol, isobutyl alcohol, active amyl alcohol, imidazole, 2-pentanol, sec-butyl alcohol, t-butanol, iso-amyl, cyclohexanol, hexyl alcohol, naphthalene, 2-pentanol, active amyl alcohol, 2-octanol and 3-methylcyclohexanol.

16. The process for manufacturing cigarettes of claim 10 wherein said compound comprises 3-methylcyclohexanol or 1-hexanol.

17. The process for manufacturing cigarettes of claim 10 wherein said compound comprises 2-octanol.

18. The process for manufacturing cigarettes of claim 10 wherein said carrier medium includes ethyl alcohol denatured with nicotine and methylene blue.

19. A tobacco smoking article comprising:

smoking tobacco;

a container in which said smoking tobacco is contained; and a compound supported by said container, said compound being associated with said smoking tobacco such that when said smoking tobacco is smoked the vapor of said compound is inhaled by the smoker in the tobacco smoke stream, and said compound being present in an amount sufficient to inhibit the selective localization of nitrosamines and metabolites thereof in the tissues of the smoker of said smoking tobacco but not to produce any toxic side effects in the smoker who is inhaling the vapor thereof in the tobacco smoke stream; wherein said compound comprises a cyclohexanol.

20. A tobacco smoking article comprising:

smoking tobacco;

a container in which said smoking tobacco is contained; and a compound supported by said container, said compound being associated with said smoking tobacco such that when said smoking tobacco is smoked the vapor of said compound is inhaled by the smoker in the tobacco smoke stream, and said compound being present in an amount sufficient to inhibit the selective localization of nitrosamines and metabolites thereof in the tissues of the smoker of said smoking tobacco but not to produce any toxic side effects in the smoker who is inhaling the vapor thereof in the tobacco smoke stream;

wherein said compound comprises 3-methylcyclohexanol or 1-hexanol.

21. A tobacco smoking article comprising:

smoking tobacco;

a container in which said smoking tobacco is contained; and a compound supported by said container, said compound being associated with said smoking tobacco such that when said smoking tobacco is smoked the vapor of said compound is inhaled by the smoker in the tobacco smoke stream, and said compound being present in an amount sufficient to inhibit the selective localization of nitrosamines and metabolites thereof in the tissues of the smoker of said smoking tobacco but not to produce any toxic side effects in the smoker who is inhaling the vapor thereof in the tobacco smoke stream; wherein said compound comprises 2-octanol.

22. A tobacco smoking article comprising:

smoking tobacco;

a container in which said smoking tobacco is contained; and a compound supported by said container, said compound being associated with said smoking tobacco such that when said smoking tobacco is smoked the vapor of said compound is inhaled by the smoker in the tobacco smoke stream, and said compound being present in an amount sufficient to inhibit the selective localization of nitrosamines and metabolites thereof in the tissues of the smoker of said smoking tobacco but not to produce any toxic side effects in the smoker who is inhaling the vapor thereof in the tobacco smoke stream;

wherein said compound is a solid at ambient temperature.

23. The tobacco smoking article of claim 22 wherein said compound is metyrapone, diethyldithiocarbamate, piperonal, imidazole or napthalene.

24. A tobacco smoking article comprising:

smoking tobacco;

a container in which said smoking tobacco is contained; and a compound supported by said container, said compound being associated with said smoking tobacco such that when said smoking tobacco is smoked the vapor of said compound is inhaled by the smoker in the tobacco smoke stream, and said compound being present in an amount sufficient to inhibit the selective localization of nitrosamines and metabolites thereof in the tissues of the smoker of said smoking tobacco but not to produce any toxic side effects in the smoker who is inhaling the vapor thereof in the tobacco smoke stream;

wherein said compound comprises an alcohol which is sprayed in an ethyl alcohol solution onto said smoking tobacco.

25. A tobacco smoking article comprising:

smoking tobacco;

a container in which said smoking tobacco is contained; and a compound supported by said container, said compound being associated with said smoking tobacco such that when said smoking tobacco is smoked the vapor of said compound is inhaled by the smoker in the tobacco smoke stream, and said compound being present in an amount sufficient to inhibit the selective localization of nitrosamines and metabolites thereof in the tissues of the smoker of said smoking tobacco but not to produce any toxic side effects in the smoker who is inhaling the vapor thereof in the tobacco smoke stream;

wherein said compound is selected from the group of metyrapone, DMSO—ip, n-butanol, t-butanol, ethanol, diethyldithiocarbamate, benzyl isothiocyanate, piperonal, isoamyl alcohol, isobutyl alcohol, active amyl alcohol, imidazole, 2-pentanol, sec-butyl alcohol, t-butanol, iso-amyl, cyclohexanol, hexyl alcohol, naphthalene, 2-pentanol, active amyl alcohol, 2-octanol and 3-methylcyclohexanol.

26. A cigarette tobacco flavoring system comprising:

at least one compound, said compound being associated with smoking tobacco such that when the smoking tobacco is smoked the vapor of said compound is inhaled by the smoker in the tobacco smoke stream, said compound being present in an amount sufficient to inhibit the selective localization of nitrosamines and metabolites thereof in the tissues of the smoker but not to produce any toxic side effects in the smoker who is inhaling the vapor thereof in the tobacco smoke stream;

flavorant;

a carrier medium; and wherein said compound comprises 3-methylcyclohexanol or 1-hexanol.

27. The cigarette tobacco flavoring system of claim 26 wherein said carrier medium comprises ethyl alcohol.

28. The cigarette tobacco flavoring system of claim 26 wherein said carrier medium comprises generally 50% of ethyl alcohol by volume of said system and generally 37% water.

29. A cigarette tobacco flavoring system comprising:

at least one compound, said compound being associated with smoking tobacco such that when the smoking tobacco is smoked the vapor of said compound is inhaled by the smoker in the tobacco smoke stream, said compound being present in an amount sufficient to inhibit the selective localization of nitrosamines and metabolites thereof in the tissues of the smoker but not to produce any toxic side effects in the smoker who is inhaling the vapor thereof in the tobacco smoke stream;

flavorant;

a carrier medium; and wherein said compound comprises 2-octanol.

30. The cigarette tobacco flavoring system of claim 29 wherein said carrier medium comprises ethyl alcohol.

31. The cigarette tobacco flavoring system of claim 29 wherein said carrier medium comprises generally 50% of ethyl alcohol by volume of said system and generally 37% water.

32. A cigarette tobacco flavoring system comprising:

at least one compound, said compound being associated with smoking tobacco such that when the smoking tobacco is smoked the vapor of said compound is inhaled by the smoker in the tobacco smoke stream, said compound being present in an amount sufficient to inhibit the selective localization of nitrosamines and metabolites thereof in the tissues of the smoker but not to produce any toxic side effects in the smoker who is inhaling the vapor thereof in the tobacco smoke stream;

flavorant;

a carrier medium; and wherein said compound comprises a cyclohexanol.

33. The cigarette tobacco flavoring system of claim 22 wherein said carrier medium comprises ethyl alcohol.

34. The cigarette tobacco flavoring system of claim 22 wherein said carrier medium comprises generally 50% of ethyl alcohol by volume of said system and generally 37% water.

35. A cigarette tobacco flavoring system comprising:

at least one compound, said compound being associated with smoking tobacco such that when the smoking tobacco is smoked the vapor of said compound is inhaled by the smoker in the tobacco smoke stream, said compound being present in an amount sufficient to inhibit the selective localization of nitrosamines and metabolites thereof in the tissues of the smoker but not to produce any toxic side effects in the smoker who is inhaling the vapor thereof in the tobacco smoke stream;

flavorant; and a carrier medium;

wherein said carrier medium comprises ethyl alcohol; and wherein said ethyl alcohol is denatured with nicotine and methylene blue.

36. A cigarette tobacco flavoring system comprising:

at least one compound, said compound being associated with smoking tobacco such that when the smoking tobacco is smoked the vapor of said compound is inhaled by the smoker in the tobacco smoke stream, said compound being present in an amount sufficient to inhibit the selective localization of nitrosamines and metabolites thereof in the tissues of the smoker but not to produce any toxic side effects in the smoker who is inhaling the vapor thereof in the tobacco smoke stream;

flavorant;

a carrier medium; and wherein said compound comprises cyclohexanol and 2-octanol.

37. The cigarette tobacco flavoring system of claim 36 wherein said flavorant comprises artificial deer tongue and apple tobacco flavor.

38. A cigarette tobacco flavoring system comprising:

at least one compound, said compound being associated with smoking tobacco such that when the smoking tobacco is smoked the vapor of said compound is inhaled by the smoker in the tobacco smoke stream, said compound being present in an amount sufficient to inhibit the selective localization of nitrosamines and metabolites thereof in the tissues of the smoker but not to produce any toxic side effects in the smoker who is inhaling the vapor thereof in the tobacco smoke stream;

flavorant;

a carrier medium; and wherein said compound comprises 5.39% by volume of cyclohexanol, 0.54% 2-octanol, and said flavorant comprises herbal maskant 0.837386 of 0.05%, herbal maskant 0.837383 of 0.05%, artificial deer tongue of 0.10%, apple tobacco flavor of 0.15% and artificial maple of 0.10%, and said carrier medium comprises ethyl alcohol denatured with nicotine and methylene blue of 56.12% and water of 37.50%.

39. A cigarette tobacco flavoring system comprising:

at least one compound, said compound being associated with smoking tobacco such that when the smoking tobacco is smoked the vapor of said compound is inhaled by the smoker in the tobacco smoke stream, said compound being present in an amount sufficient to inhibit the selective localization of nitrosamines and metabolites thereof in the tissues of the smoker but not to produce any toxic side effects in the smoker who is inhaling the vapor thereof in the tobacco smoke stream;

flavorant;

a carrier medium; and wherein said compound comprises cyclohexanol of 5.34% by volume and 2-octanol of 0.54%, and said flavorant comprises herbal maskant 0.837386 of 0.10%, herbal maskant 0.837383 of 0.10%, artificial deer tongue of 0.10%, apple tobacco flavor of 1.5% and artificial maple of 0.10%, and said carrier medium comprises ethyl alcohol denatured with nicotine and methylene blue of 56.02% and water of 37.50%.

40. A cigarette tobacco flavoring system comprising:

at least one compound, said compound being associated with smoking tobacco such that when the smoking tobacco is smoked the vapor of said compound is inhaled by the smoker in the tobacco smoke stream, said compound being present in an amount sufficient to inhibit the selective localization of nitrosamines and metabolites thereof in the tissues of the smoker but not to produce any toxic side effects in the smoker who is inhaling the vapor thereof in the tobacco smoke stream;

flavorant;

a carrier medium; and wherein said compound comprises cyclohexanol of 0.81%, said flavorant comprises artificial deer tongue of 0.10% and apple tobacco flavor of 0.10%, and said carrier medium comprises ethyl alcohol denatured with nicotine and methylene blue of 98.99%.

* * * * *